US008727525B2

(12) United States Patent
Houjou

(10) Patent No.: US 8,727,525 B2
(45) Date of Patent: May 20, 2014

(54) INKJET RECORDING APPARATUS

(75) Inventor: Hiroaki Houjou, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 70 days.

(21) Appl. No.: 13/184,178

(22) Filed: Jul. 15, 2011

(65) Prior Publication Data

US 2012/0013671 A1 Jan. 19, 2012

(30) Foreign Application Priority Data

Jul. 16, 2010 (JP) ..... 2010-161952

(51) Int. Cl.
*B41J 2/01* (2006.01)

(52) U.S. Cl.
USPC ..... 347/101; 347/17; 347/102

(58) Field of Classification Search
USPC ..... 347/15, 101, 102, 103, 5, 17
See application file for complete search history.

(56) References Cited

U.S. PATENT DOCUMENTS

| | | | | |
|---|---|---|---|---|
| 5,764,263 | A * | 6/1998 | Lin | 347/101 |
| 6,244,700 | B1 * | 6/2001 | Kimura et al. | 347/102 |
| 7,357,472 | B2 * | 4/2008 | Yamanobe | 347/15 |
| 7,517,076 | B2 * | 4/2009 | Stelter et al. | 347/103 |
| 7,768,675 | B2 * | 8/2010 | Nishi | 358/296 |
| 2003/0161552 | A1 | 8/2003 | Shima et al. | |
| 2003/0164958 | A1 | 9/2003 | Shima et al. | |
| 2009/0079784 | A1 * | 3/2009 | Chiwata et al. | 347/21 |
| 2009/0231407 | A1 | 9/2009 | Kachi | |

FOREIGN PATENT DOCUMENTS

| | | | |
|---|---|---|---|
| JP | 03-151239 | A | 6/1991 |
| JP | 2001-212953 | A | 8/2001 |
| JP | 2003-237036 | A | 8/2003 |
| JP | 2003-266665 | A | 9/2003 |
| JP | 2008-179012 | A | 8/2008 |
| JP | 2009-220411 | A | 10/2009 |

OTHER PUBLICATIONS

Japanese Office Action issued in JP 2010-161952 on Aug. 23, 2013 and a partial English translation of same.

* cited by examiner

*Primary Examiner* — Lam S Nguyen
(74) *Attorney, Agent, or Firm* — Birch, Stewart, Kolasch & Birch, LLP.

(57) ABSTRACT

An inkjet recording apparatus includes: an image formation unit which deposits aqueous ink onto a recording surface of a recording sheet to form an image on the recording surface; a drying unit which dries the recording surface on which the image has been formed, the drying unit including a double-side heat application device which performs drying of the recording surface by applying heat to both the recording surface and a rear surface of the recording sheet opposite to the recording surface; and a drying control unit which controls a first intensity of heat applied to the recording surface and a second intensity of heat applied to the rear surface independently from each other, in accordance with a thickness of the recording sheet.

6 Claims, 7 Drawing Sheets

FIG.7

| | | OK TOP COAT + 104 gsm | | OK TOP COAT + 127 gsm | | OK TOP COAT + 157 gsm | | IBEST 210 gsm | | IBEST 310 gsm | |
|---|---|---|---|---|---|---|---|---|---|---|---|
| HEATING INTENSITY FOR RECORDING SURFACE | HEATING INTENSITY FOR REAR SURFACE | COCKLING | STACKER BLOCKING | COCKLING | STACKER BLOCKING | COCKLING | STACKER BLOCKING | COCKLING | STACKER BLOCKING | COCKLING | STACKER BLOCKING |
| STRONG | STRONG | A | A | A | A | A | AB | A | AB | A | B |
| STRONG | MEDIUM | AB | A | A | A | A | B | A | B | A | C |
| STRONG | WEAK | B | A | AB | AB | A | C | A | C | A | C |
| MEDIUM | STRONG | B | A | A | A | A | A | A | AB | A | AB |
| MEDIUM | MEDIUM | C | A | AB | A | A | AB | A | AB | A | B |
| MEDIUM | WEAK | C | A | B | A | A | B | A | B | A | C |
| WEAK | STRONG | C | A | AB | A | A | A | A | A | A | AB |
| WEAK | MEDIUM | C | A | B | A | A | AB | A | B | A | B |
| WEAK | WEAK | C | A | C | AB | A | C | A | C | A | C |

INKJET RECORDING APPARATUS

BACKGROUND OF THE INVENTION

1. Field of the Invention

The present invention relates to an inkjet recording apparatus, and more particularly to technology for effectively suppressing both cockling and stacker blocking while maintaining drying performance.

2. Description of the Related Art

In an inkjet recording method in which droplets of aqueous ink are deposited onto a sheet of recording medium, such as paper, cellulose fibers in the sheet swell and deform due to permeation of the water contained in the ink into the sheet, and a phenomenon (hereinafter referred to as "cockling") occurs, in which the image formation area of the sheet becomes undulated. When cockling occurs, recording quality is degraded, and therefore cockling is a particularly serious problem when the ink deposition volume is large.

Furthermore, when performing double-side printing, ink droplets are deposited onto the rear surface of a sheet of recording medium in which cockling has occurred due to the ink deposition on the front surface, and therefore the sheet may come into contact with the ink ejection head, which gives rise to an even greater problem.

In order to suppress cockling, it is necessary to dry the recording surface swiftly after the ink deposition, in order to suppress the permeation of the water contained in the ink into the sheet of recording medium, as much as possible. For example, Japanese Patent Application Publication No. 2008-179012 discloses promoting drying of printed surfaces of a sheet of recording medium through heating a recording surface and a rear surface, by hot air flow drying of the printed surface of the sheet while heating and conveying the sheet with the rear surface of the sheet in tight contact with a drum contact surface adjusted to a prescribed temperature.

However, if drying of the recording surface is promoted, the temperature of the recording surface becomes excessively high in the output section after drying and a phenomenon (hereinafter referred to as "stacker blocking") occurs due to the sheets of recording medium sticking together when the sheets are stacked up in the output tray or stacker.

In this way, if drying of the recording surface is promoted in order to suppress cockling, stacker blocking occurs, whereas if the promotion of drying of the recording surface is restricted in order to avoid the occurrence of stacker blocking, then cockling occurs. Furthermore, even if the drying of the recording surface is not adequate due to insufficient drying, stacker blocking still occurs and therefore it is necessary to maintain drying performance.

In the drying unit of inkjet recording apparatus in the related art, it is not currently possible to suppress the occurrence of both cockling and stacker blocking, while maintaining drying performance.

SUMMARY OF THE INVENTION

The present invention has been contrived in view of these circumstances, an object thereof being to provide an inkjet recording apparatus whereby both cockling and stacker blocking can be effectively suppressed while maintaining drying performance.

In order to attain the aforementioned object, the present invention is directed to an inkjet recording apparatus, comprising: an image formation unit which deposits aqueous ink onto a recording surface of a recording sheet to form an image on the recording surface; a drying unit which dries the recording surface on which the image has been formed, the drying unit including a double-side heat application device which performs drying of the recording surface by applying heat to both the recording surface and a rear surface of the recording sheet opposite to the recording surface; and a drying control unit which controls a first intensity of heat applied to the recording surface and a second intensity of heat applied to the rear surface independently from each other, in accordance with a thickness of the recording sheet.

Here, independently controlling the first and second intensities means individually controlling the temperature or amount of applied heat for each of the recording surface and the rear surface. Furthermore, the thickness of the recording sheet can be expressed by the basis weight of the recording sheet.

According to this aspect of the present invention, when promoting drying of the recording surface on which the image has been formed, by heating both the recording surface and the rear surface of the recording sheet, the intensities of heat applied to the recording surface and the rear surface are controlled independently in accordance with the thickness of the recording sheet, and therefore it is possible to suppress both cockling and stacker blocking effectively while maintaining drying performance.

Preferably, the drying control unit makes the second intensity greater than the first intensity as the thickness of the recording sheet increases.

The greater the thickness of the recording sheet, the less liable cockling is to occur, but the recording sheet having a large thickness has a large heat capacity and therefore the temperature of the recording surface which has been raised by drying falls less readily. For this reason, the printed surface has stickiness and therefore stacker blocking is liable to occur. Furthermore, if the recording sheet is thick, then insufficient drying becomes liable to occur, and stacker blocking due to insufficient drying becomes liable to arise.

According to this aspect of the present invention, by controlling the intensity of heat applied to the rear surface so as to be greater than the intensity of heat applied to the recording surface, the larger the thickness of the recording sheet, it is possible to suppress rise in the temperature of the recording surface, while maintaining drying performance. By this means, it is possible to suppress the occurrence of stacker blocking effectively.

Preferably, the inkjet recording apparatus further comprises: a data storage unit in which a data table of correspondence between a deposition volume of the aqueous ink and an allowable limit temperature of the recording surface after drying is stored for each recording sheet type corresponding to the thickness of the recording sheet; and a data input unit through which data of the recording sheet type and the deposition volume of the aqueous ink is input, wherein the drying control unit controls the first and second intensities independently from each other so that temperature of the recording surface does not exceed the allowable limit temperature selected from the data table of correspondence in accordance with the input data of the recording sheet type and the deposition volume of the aqueous ink.

According to this aspect of the present invention, it is possible to heat the recording surface to the highest temperature at which stacker blocking is avoided, and hence the occurrence of stacker blocking can be suppressed while promoting drying of the recording surface in such a manner that cockling does not occur.

Preferably, the inkjet recording apparatus further comprises: a temperature sensor of a non-contact type which measures temperature of the recording surface that has been dried by the drying unit, wherein the drying control unit controls the first and second intensities independently from each other in accordance with the temperature measured by the temperature sensor.

According to this aspect of the present invention, by actually measuring the temperature of the recording surface after drying, it is possible to raise the temperature of the recording surface to the limit at which stacker blocking does not occur, and therefore it is possible to suppress stacker blocking while maintaining drying performance effectively.

Preferably, the inkjet recording apparatus further comprises: an expansion and contraction amount sensor which measures an amount of expansion and contraction of the recording sheet after the aqueous ink has been deposited on the recording surface thereof by the image formation unit, wherein the drying control unit controls the first and second intensities independently from each other in accordance with the amount of expansion and contraction measured by the expansion and contraction amount sensor.

Cockling occurs due to the expansion and deformation of the cellulose fibers as a result of permeation of the aqueous ink into the recording sheet, and the actual amount of expansion of the cellulose fibers varies depending on the ambient temperature and humidity conditions in which the inkjet recording apparatus is used. For example, during rainy or wet season, the recording sheet has absorbed moisture and expanded to some extent before the aqueous ink is deposited thereon, which means that the rate of expansion upon deposition of ink becomes smaller. Conversely, in dry season, the recording sheet has dried out, and therefore the rate of expansion upon deposition of ink becomes larger.

According to this aspect of the present invention, by individually controlling the intensities of heat applied to the recording surface and the rear surface in accordance with the actual amount of expansion and contraction of the recording sheet on which the aqueous ink has been deposited by the image formation unit, it is possible to suppress cockling accurately, irrespective of the ambient temperature and humidity conditions in which the inkjet recording apparatus is situated.

Preferably, the drying unit includes: a drum which holds and conveys the recording sheet of which the rear surface is held in contact with an outer circumferential surface of the drum; a first heating device which is arranged along the outer circumferential surface of the drum and applies heat to the recording surface of the recording sheet of which the rear surface is held in contact with the outer circumferential surface of the drum; and a second heating device which heats the outer circumferential surface of the drum so as to apply heat to the rear surface that is held in contact with the outer circumferential surface of the drum.

According to this aspect of the present invention, by adopting the contact heating method which applies heat to the rear surface of the recording sheet by making contact with the outer circumferential surface of the drying drum in this way, it is possible to improve the response and accuracy of the control of application of heat to the rear surface of the recording sheet.

Preferably, the inkjet recording apparatus further comprises a treatment liquid deposition device which deposits treatment liquid onto the recording surface of the recording sheet, the treatment liquid deposition device being arranged before the image formation unit, the treatment liquid containing an aggregating agent having a function of increasing viscosity of the aqueous ink.

According to this aspect of the present invention, by rapidly aggregating the aqueous ink deposited on the recording surface and raising the viscosity of the aqueous ink, cockling and stacker blocking can be made less liable to occur.

Preferably, the inkjet recording apparatus further comprises a curing unit which cures the image formed on the recording surface and is arranged after the drying unit.

According to this aspect of the present invention, by curing the image formed on the recording surface, it is possible to make stacker blocking even less liable to occur.

It is also preferable that an inkjet recording apparatus comprises two inkjet recording apparatuses arranged in series, each of the two inkjet recording apparatuses being as described above, images being formed on both surfaces of the recording sheet.

In the case of the inkjet recording apparatus of a double-side printing type which forms images on both surfaces of the recording sheet, ink deposition is performed onto the rear surface of the recording sheet in which cockling has occurred due to the ink deposition on the front surface, and therefore the recording sheet may make contact with the ink ejection head, and the present invention is even more effective in this case.

According to the inkjet recording apparatus of the present invention, it is possible effectively to suppress cockling and stacker blocking while maintaining drying performance. Furthermore, the present invention is especially effective in an apparatus composition for double-side printing which forms images on both surfaces of a recording sheet.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein:

FIG. 7 is a table for describing practical examples.

DETAILED DESCRIPTION OF THE PREFERRED EMBODIMENTS

General Composition of Inkjet Recording Apparatus

Firstly, the general composition of an inkjet recording apparatus according to an embodiment of the present invention is described.

Figure 1:
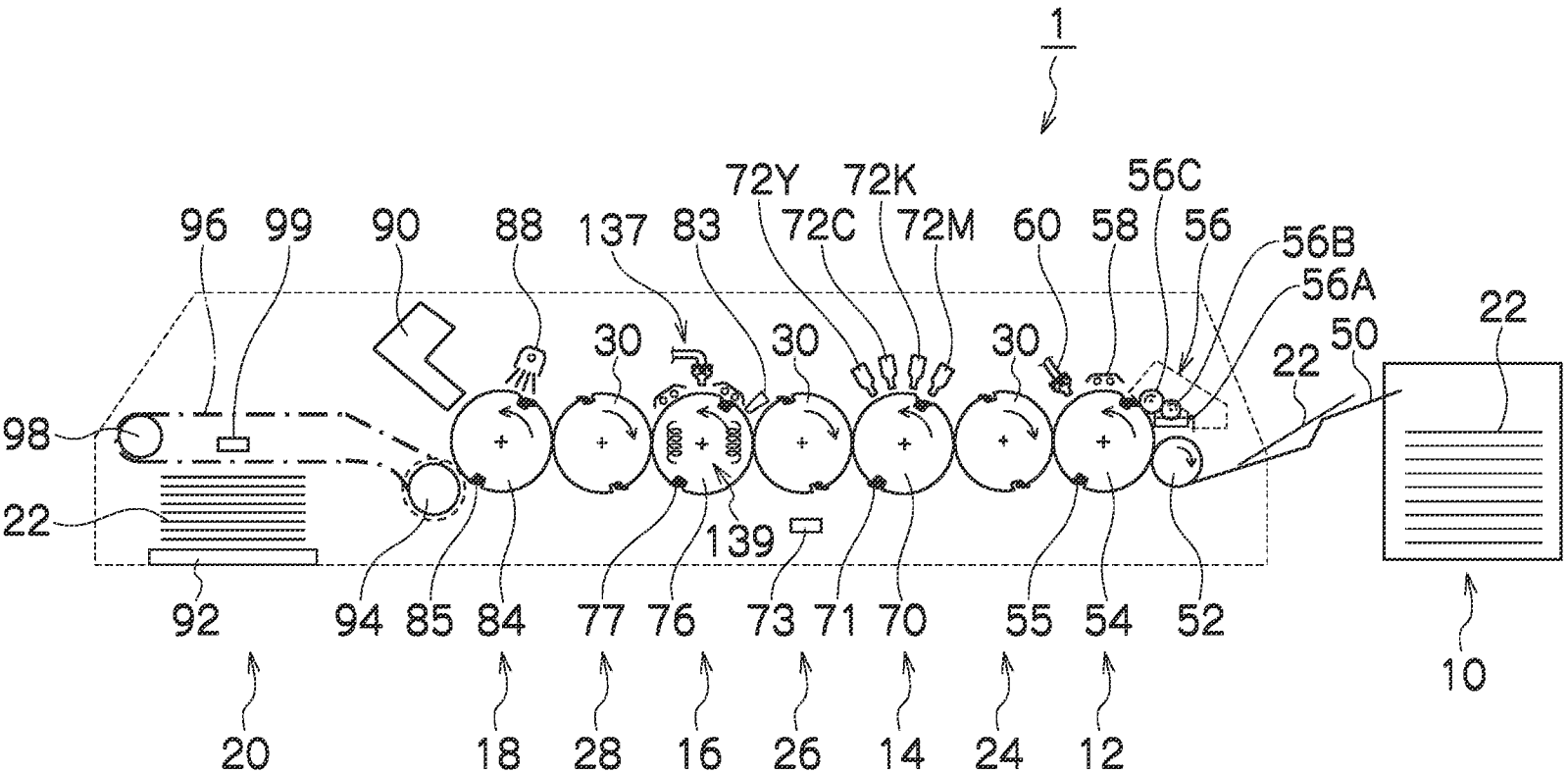
FIG. 1 is a schematic drawing for describing the overall composition of an inkjet recording apparatus according to an embodiment of the present invention.

FIG. 1 is a conceptual diagram showing the general composition of an inkjet recording apparatus 1 according to the embodiment of the present invention.

The inkjet recording apparatus 1 shown in FIG. 1 is an apparatus which forms an image on a recording surface of a sheet of recording medium (hereinafter referred to as the "recording sheet") 22. The inkjet recording apparatus 1 includes a recording sheet feed unit 10, a treatment liquid deposition unit 12, an image formation unit 14, a drying unit 16, a curing unit 18 and an output unit 20.

The recording sheets 22 (e.g., cut sheets of paper) are stacked in the recording sheet feed unit 10. Each recording sheet 22 is supplied from the recording sheet feed unit 10 to the treatment liquid deposition unit 12, treatment liquid is deposited onto the recording surface of the recording sheet 22 by the treatment liquid deposition unit 12, and then droplets of aqueous inks of respective colors (hereinafter referred to simply as "ink") are deposited onto the recording surface by the image formation unit 14. The water content in the recording sheet 22 onto which the ink have been deposited is dried by the drying unit 16, whereupon the image is made durable by the curing unit 18, and then the recording sheet 22 is conveyed by the output unit 20 and stacked in an output tray or stacker 92.

Intermediate conveyance units (transfer drums) 24, 26 and 28 are arranged between these respective units, and the recording sheet 22 is transferred by these intermediate conveyance units 24, 26 and 28. More specifically, a first intermediate conveyance unit 24 is arranged between the treatment liquid deposition unit 12 and the image formation unit 14, and the recording sheet 22 is transferred from the treatment liquid deposition unit 12 to the image formation unit 14 by the first intermediate conveyance unit 24. A second intermediate conveyance unit 26 is arranged between the image formation unit 14 and the drying unit 16, and the recording sheet 22 is transferred from the image formation unit 14 to the drying unit 16 by the second intermediate conveyance unit 26. A third intermediate conveyance unit 28 is arranged between the drying unit 16 and the curing unit 18, and the recording sheet 22 is transferred from the drying unit 16 to the curing unit 18 by the third intermediate conveyance unit 28.

Figure 2:
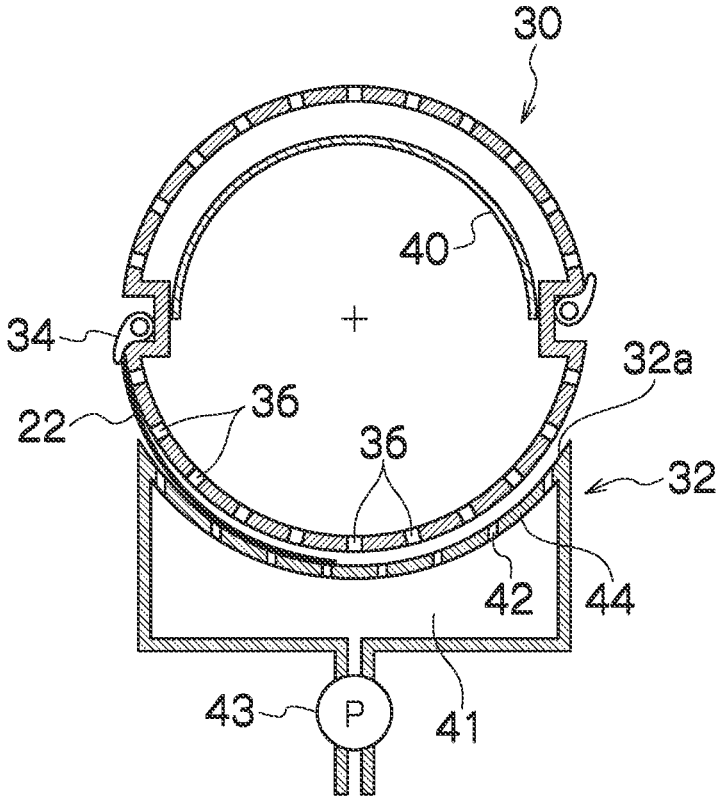
FIG. 2 is a cross-sectional diagram for describing the structure of an intermediate conveyance unit.

The first to third intermediate conveyance units 24, 26 and 28 have a common structure, and as shown in FIG. 2, are constituted of an intermediate conveyance body 30 and a conveyance guide 32.

The intermediate conveyance body 30 is arranged rotatably, and a plurality of air blowing ports 36 for blowing out air flow toward the recording surface of the recording sheet 22 are formed in the surface of the intermediate conveyance body 30. In this case, it is desirable to blow the air flow substantially perpendicularly onto the recording surface of the recording sheet 22 from the air blowing ports 36. By means of the air flow blown out from the air blowing ports 36, the recording sheet 22 is caused to move along the conveyance guide 32 when conveyed in rotation, and therefore it is possible to avoid contact between the intermediate conveyance body 30 and the recording surface of the recording sheet 22, and hence adherence of the treatment liquid to the intermediate conveyance body 30 can be avoided.

Moreover, the intermediate conveyance body 30 is provided internally with an air flow restrictor guide 40, which partially restricts the air flow blown out from the air blowing ports 36. The air flow restrictor guide 40 restricts the direction of the air flow in such a manner that the air flow is blown out from only the blowing ports 36 facing the recording surface of the recording sheet 22. By restricting the direction of the air blow by means of the air flow restrictor guide 40, the recording sheet 22 is more reliably made to pass along the conveyance guide 32 while moving in rotation, due to the air flow which is blown out from the air blowing ports 36, and therefore it is possible to avoid contact between the intermediate conveyance body 30 and the recording surface of the recording sheet 22 more reliably, and hence adherence of the treatment liquid to the intermediate conveyance body 30 can be avoided. Furthermore, the air flow blown out from the air blowing ports 36 applies a positive pressure by blowing onto the recording surface of the recording sheet 22, but also displays a function as a back tension applicator which causes a force to act in the opposite direction to the direction of rotation of the recording sheet 22, and hence the recording sheet 22 is moved in rotation while being applied with the back tension to the recording surface of the recording sheet 22. By this means, when the recording sheet 22 is conveyed to be tightly held on an image formation drum 70 with the leading end of the recording sheet 22 being held by a holding device 71 of the image formation drum 70, for example, then the back tension acts on the recording surface at the trailing end of the recording sheet 22 due to the air flow blown from the air blowing ports 36, and therefore wrinkles and floating up do not occur when the recording sheet 22 is conveyed to the image formation drum 70.

The conveyance guide 32 is arranged in close proximity to the intermediate conveyance body 30. The conveyance guide 32 is formed in a circular arc shape, and the rotational movement of the recording sheet 22 is guided while causing the back tension to act on the rear surface of the recording sheet 22. More specifically, the conveyance guide 32 has a guide surface 32*a*, which opposes a position where the holding device 34 of the intermediate conveyance body 30 traces a circular path and which guides the conveyance of the recording sheet 22. The conveyance guide 32 has a back tension application device which causes a force to act in the opposite direction to the direction of rotation of the recording sheet 22. The back tension application device may be a negative pressure application device which applies a negative pressure to the rear surface of the recording sheet 22. More specifically, as the negative pressure application device, it is possible to arrange a plurality of suction apertures 42 in the guide surface 32*a*, a chamber 41, which is coupled to the suction apertures 42, a pump 43, which is connected to the chamber 41, and the like.

The guide surface 32*a* includes a plurality of supporting sections 44, which support and guide the recording sheet 22.

By this means, when the recording sheet 22 is conveyed to be tightly held on the image formation drum 70 with the leading end of the recording sheet 22 being held by the holding device 71 of the image formation drum 70, for example, then the back tension acts on the rear or non-recording surface at the trailing end of the recording sheet 22 due to the suction through the suction apertures 42, and therefore wrinkles and floating up do not occur when the recording sheet 22 is conveyed to the image formation drum 70. On the basis of the intermediate conveyance body 30 and the conveyance guide 32 having these compositions, the recording sheet 22 is rotated with the leading end thereof being held by the holding device 34 of the intermediate conveyance body 30, while the rear surface of the recording sheet 22 is held by suction by the negative pressure with the pump 43 through the suction apertures 42 in the supporting section 44 of the conveyance guide 32. Therefore, the recording sheet 22 performs a rotational movement while being supported and guided by the supporting sections 44. Thereafter, the recording sheet 22 is transferred from the holding device 34 of the intermediate conveyance body 30 to the holding device 71 of the image formation drum 70, or the like.

By thus composing the first to third intermediate conveyance units 24, 26 and 28, the recording sheet 22 can be conveyed while the rear surface is supported by the supporting sections 44 and the recording surface is not in contact with the constituent members of the intermediate conveyance body 30 and the conveyance guide 32.

Consequently, the layer of the treatment liquid that has been deposited on the recording surface of the recording sheet 22 by the treatment liquid deposition unit 12 does not suffer non-uniformities in the amount of treatment liquid or any defects, but is kept in an unaltered state.

Furthermore, when the recording sheet 22 is conveyed to be tightly held on the image formation drum 70 with the leading end of the recording sheet 22 being held by the holding device 71 of the image formation drum 70, the back tension acts on the recording surface and the non-recording surface of the recording sheet 22, and an image of high quality is formed without the occurrence of wrinkles or floating when the recording sheet 22 is conveyed to the image formation drum 70.

Next, the main units of the inkjet recording apparatus 1 (the recording sheet feed unit 10, treatment liquid deposition unit 12, image formation unit 14, drying unit 16, curing unit 18, output unit 20) will be described.

<Recording Sheet Feed Unit>

The recording sheet feed unit 10 is a mechanism which supplies the recording sheets 22 to the image formation unit 14. The recording sheet feed unit 10 has a recording sheet feed tray 50, and the recording sheets 22 are supplied one sheet at a time to the treatment liquid deposition unit 12 from the recording sheet feed tray 50.

<Treatment Liquid Deposition Unit>

The treatment liquid deposition unit 12 is a mechanism which deposits the treatment liquid onto the recording surface of the recording sheet 22. The treatment liquid includes a coloring material aggregating agent which aggregates or precipitates the coloring material (pigment) in the ink to be deposited by the image formation unit 14. The separation of the ink into the coloring material and the solvent is promoted due to the treatment liquid making contact with the ink. A more detailed description of the treatment liquid is given later.

As shown in FIG. 1, the treatment liquid deposition unit 12 includes a transfer drum 52, a treatment liquid drum 54, a treatment liquid application device 56, an IR (infrared) heater 58 and a hot air flow blowing nozzle 60. The transfer drum 52 is disposed between the recording sheet feed tray 50 of the recording sheet feed unit 10 and the treatment liquid drum 54. The transfer drum 52 has a hook-shaped holding device (gripper, or the like) on the outer circumferential surface thereof, and conveys the recording sheet 22 in rotation while holding the leading end of the recording sheet 22 with the holding device. The recording sheet 22 supplied from the recording sheet feed unit 10 is received by the transfer drum 52 and transferred onto the treatment liquid drum 54.

The treatment liquid drum 54 is a drum which holds the recording sheet 22 and conveys the recording sheet 22 by rotation, and this drum is driven so as to rotate. The treatment liquid drum 54 has a hook-shaped holding device 55 arranged on the outer circumferential surface of the drum, in such a manner that the leading end of the recording sheet 22 can be held by the holding device 55. The recording sheet 22 is conveyed by rotation due to the treatment liquid drum 54 rotating in a state where the leading end is held by the holding device 55. The treatment liquid application device 56, the IR heater 58 and the hot air flow blowing nozzle 60 are arranged to face the outer circumferential surface of the treatment liquid drum 54. The treatment liquid application device 56, the IR heater 58 and the hot air flow blowing nozzle 60 are disposed in sequence from the upstream side in the direction of rotation of the treatment liquid drum 54 (the counter-clockwise direction in FIG. 1), and the recording sheet 22 is firstly coated with the treatment liquid on the recording surface thereof by the treatment liquid application device 56. The film thickness of the treatment liquid is desirably sufficiently smaller than the diameter of the ink droplets which are ejected from inkjet heads 72M, 72K, 72C and 72Y of the image formation unit 14. For example, if the droplet ejection volume of the ink is 2 pl, then the average diameter of the droplets is 15.6 μm. In this case, if the film thickness of the treatment liquid is too large, then the ink droplets float inside the treatment liquid film without making contact with the surface of the recording sheet 22. Therefore, in order to obtain a diameter of 30 μm or more in the deposited dots when the ink droplet ejection volume is 2 pl, it is desirable that the film thickness of the treatment liquid is 3 μm or less.

The deposited amount of aggregating agent in the treatment liquid deposited by the treatment liquid deposition unit 12 is not limited in particular, provided that the treatment liquid is capable of aggregating the ink composition, but desirably the deposited amount of aggregating agent is not less than 0.1 $g/m^2$. More desirably, the deposited amount of aggregating agent is in the range of 0.2 $g/m^2$ to 0.7 $g/m^2$. If the deposited amount is not less than 0.1 $g/m^2$, then the aggregating agent maintains good high-speed aggregating properties in accordance with various modes of use of the ink composition. Moreover, it is desirable if the deposited amount of aggregating agent is not more than 0.7 $g/m^2$, since no adverse effects are caused to the surface properties of the recording medium to which it is applied (no change in luster, or the like).

As shown in FIG. 1, the treatment liquid application device 56 is principally constituted of a treatment liquid container 56A, a dosing roller 56B and an application roller 56C. The treatment liquid is stored in the treatment liquid container 56A and a portion of the dosing roller 56B is immersed in the treatment liquid in the treatment liquid container 56A. For the dosing roller 56B, it is suitable to use a metal roller or an anilox roller in which a plurality of cells are regularly formed in a uniform number of lines on the circumferential surface of the metal roller with a ceramic coating on the surface thereof. For the material of the metal roller, it is possible to use iron, stainless steel, or the like. If iron is used as the material of the roller, then in order to improve the hydrophilic properties of the surface, as well as improving resistance to wear and anti-rusting properties, the surface may be provided with chromium plating or the like. For the cell structure of the anilox roller, it is desirable to use a structure having a line number of not less than 150 lines and not more than 400 lines, a cell depth of not smaller than 20 μm and not larger than 75 μm, and a cell volume of not smaller than 30 $cm^3/m^2$ and not larger than 60 $cm^3/m^2$. The diameter of the dosing roller is, for example, not smaller than 20 mm and not larger than 100 mm.

The dosing roller 56B is rotatably supported, is connected to a motor (not shown) and is driven to rotate at a uniform speed. Consequently, the treatment liquid in the treatment liquid container 56A is caused to adhere to the surface of the dosing roller 56B, and this treatment liquid can be transferred to the surface of the application roller 56C. The direction of rotation of the dosing roller 56B is the same as that of the application roller 56C, and the circumferential speed of the outer circumference of the dosing roller 56B may be the same as the application roller 56C or may have a speed differential with respect to same. If there is a speed differential, then it is appropriate that the circumferential speed of the dosing roller 56B is not lower than 80% and not higher than 140% of the circumferential speed of the application roller 56C. By adjusting the circumferential speeds of the application roller 56C and the dosing roller 56B, it is possible to adjust the rate of transfer of the treatment liquid from the dosing roller 56B to the application roller 56C and the thickness of the film of the treatment liquid applied to the recording sheet 22 can be adjusted.

A doctor blade (not shown) for dosing the treatment liquid is arranged so as to abut against the surface of the dosing roller 56B. The doctor blade is disposed to the upstream side of the point of contact between the dosing roller 56B and the application roller 56C, in terms of the direction of rotation of the dosing roller 56B, so as to be able to scrape off and regulate the dose of the treatment liquid to be applied on the surface of the dosing roller 56B. By this means, it is possible to supply the treatment liquid which has been dosed by the doctor blade, to the application roller 56C.

For the application roller 56C, it is suitable to use a rubber roller having a rubber layer, such as EPDM (ethylene propylene diene monomer) rubber or silicone rubber, on the surface thereof. The application roller 56C is rotatably supported, is connected to a motor (not shown) and is driven to rotate at a uniform speed. The direction of rotation of the application roller 56C is the same as that of the treatment liquid drum 54, and the circumferential speed of the outer circumference of the application roller 56C is the same as the treatment liquid drum 54. By this means, the treatment liquid transferred from the dosing roller 56B to the application roller 56C is applied to the recording sheet 22 held on the treatment liquid drum 54.

In this way, since the treatment liquid application device 56 applies the treatment liquid by means of the application roller, then it is possible to apply the treatment liquid to the recording sheet 22 uniformly and with a small application volume. Moreover, it is preferable that the treatment liquid application device 56 is capable of contacting and separating the application roller with respect to each recording sheet, in order to prevent soiling of the conveyance drum for the treatment liquid application (the treatment liquid drum 54).

In the present embodiment, the treatment liquid application device 56 has been described above as of the composition using the roller-based application method, but the deposition of the treatment liquid is not limited to the application method and may also employ a commonly known method such as an inkjet method or immersion method, or the like. For the application method, it is possible to use a commonly known application method employing a bar coater, extrusion die coater, air doctor coater, blade coater, rod coater, knife coater, squeeze coater, reverse roll coater, or the like.

The treatment liquid deposition step may be arranged either before or after the ink deposition step using an ink composition. In the present embodiment, a desirable mode is one where the ink deposition step is arranged after the treatment liquid has been deposited in the treatment liquid deposition step. More specifically, a desirable mode is one where, before depositing an ink composition onto the recording sheet 22, a treatment liquid for aggregating the pigment and/or self-dispersing polymer particles in the ink composition is deposited onto the recording sheet 22, and the ink composition is deposited to form an image so as to make contact with the treatment liquid that has been deposited on the recording sheet 22. By this means, it is possible to achieve high speed inkjet recording and an image of high density and high resolution can be obtained even if printing at high speed.

The recording sheet 22 on which the treatment liquid has been applied is conveyed to the positions of the IR heater 58 and the hot air flow blowing nozzle 60. The IR heater 58 is controlled to a high temperature (for example, 180° C.) and the hot air flow blowing nozzle 60 is composed so as to blow a hot air flow at a high temperature (for example, 70° C.) onto the recording sheet 22 at a uniform flow rate (for example, 9 $m^3$/min). By heating by means of the IR heater 58 and the hot air flow blowing nozzle 60, the water content in the solvent of the treatment liquid is evaporated off and a thin film layer of the treatment liquid is formed on the recording surface. By forming the treatment liquid as a thin layer in this way, when dots of ink formed by droplets ejected from the image formation unit 14 make contact with the recording surface of the recording sheet 22, the required dot diameter is obtained, and furthermore aggregation of the coloring material occurs due to reaction with the treatment liquid component formed in the thin layer and hence an action of fixing the coloring material to the recording surface of the recording sheet 22 can be achieved readily. The treatment liquid drum 54 may be controlled to a prescribed temperature (for example, 50° C.).

<Image Formation Unit>

As shown in FIG. 1, the image formation unit 14 includes the image formation drum 70, and the inkjet heads 72M, 72K, 72C and 72Y disposed in close proximity to the image formation drum 70 at positions facing the outer circumferential surface of the image formation drum 70. The inkjet heads 72M, 72K, 72C and 72Y correspond respectively to the four colors of magenta (M), black (K), cyan (C) and yellow (Y), and are arranged sequentially from the upstream side in terms of the direction of rotation of the image formation drum 70.

The image formation drum 70 is a drum which holds the recording sheet 22 on the outer circumferential surface thereof and conveys the recording sheet 22 by rotation, and this drum is driven so as to rotate. Furthermore, the image formation drum 70 includes a hook-shaped holding device 71 arranged on the outer circumferential surface thereof, in such a manner that the leading end of the recording sheet 22 can be held with the holding device 71. The recording sheet 22 is conveyed by rotation due to the image formation drum 70 rotating in a state where the leading end of the recording sheet 22 is held with the holding device 71. During the conveyance, the recording sheet 22 is conveyed with the recording surface thereof facing outwards, and ink is deposited onto the recording surface from the inkjet heads 72M, 72K, 72C and 72Y.

Each of the inkjet heads 72M, 72K, 72C and 72Y is a full-line type inkjet recording head (inkjet head) having a length corresponding to the maximum width of the image formation region on the recording sheet 22, and a nozzle row of a plurality of nozzles for ejecting ink arranged throughout the whole width of the image formation region is formed in the ink ejection surface of each head. Each of the inkjet heads 72M, 72K, 72Y and 72Y is disposed and fixed so as to extend in a direction perpendicular to the conveyance direction of the recording sheet 22 (the direction of rotation of the image formation drum 70).

Cassettes of the corresponding color ink are installed in each of the inkjet heads 72M, 72K, 72C and 72Y. Droplets of the respective inks are ejected from the inkjet heads 72M, 72K, 72C and 72Y toward the recording surface of the recording sheet 22 which is held on the outer circumferential surface of the image formation drum 70. By this means, the ink makes contact with the treatment liquid that has been deposited on the recording surface of the recording sheet 22 previously by the treatment liquid deposition unit 12, and the coloring material (pigment) dispersed in the ink is aggregated to form a coloring material aggregate. Consequently, flowing of coloring material, and the like, on the recording sheet 22 is prevented and an image is formed on the recording surface of the recording sheet 22. One possible example of the reaction between the ink and the treatment liquid avoids bleeding of the coloring material, intermixing between the inks of different colors, and interference between the deposited ink droplets due to combination of the ink droplets upon landing, by using a mechanism where the treatment liquid contains an acid to lower the pH in the ink composition to break down the dispersion of pigment in the ink composition and causes the pigment to aggregate.

The droplet ejection timings of the inkjet heads 72M, 72K, 72C and 72Y are synchronized with an encoder (not shown) which determines the speed of rotation and is positioned on the image formation drum 70. By this means, it is possible to specify the deposition positions of the ejected ink droplets with high accuracy. Moreover, it is possible that speed variations caused by inaccuracies in the image formation drum 70, or the like, are ascertained in advance, and the droplet ejection timings obtained by the encoder are corrected, thereby reducing droplet deposition non-uniformities, regardless of inaccuracies in the image formation drum 70, the accuracy of the rotational axle, and the speed of the outer circumferential surface of the image formation drum 70.

Maintenance operations, such as cleaning the nozzle surfaces of the inkjet heads 72M, 72K, 72C and 72Y, ejecting ink of increased viscosity, and the like, are carried out with the head unit in a withdrawn state from the image formation drum 70.

Although the configuration with the four standard colors of C, M, Y and K is described in the present embodiment, the combinations of the ink colors and the number of colors are not limited to these. Light and/or dark inks, and special color inks can be added as required. For example, a configuration is possible in which inkjet heads for ejecting light-colored inks, such as light cyan and light magenta, are added. There is no particular restriction on the arrangement sequence of the heads of the respective colors.

In the present embodiment, it is desirable that a region where no image is formed is arranged in the trailing end of the recording sheet 22 in the direction of conveyance. By providing a region where no image is formed, it is possible to cause the recording sheet 22 to be held tightly to the drying drum 76 by pressing this region with a non-contact-type of recording sheet pressing device in the drying unit 16, and this can be done without damaging the image.

An expansion and contraction amount sensor 73 is arranged between the image formation unit 14 and the drying unit 16. The expansion and contraction amount sensor 73 measures the amount of expansion and contraction of the recording sheet 22 onto which the ink droplets have been deposited in the image formation unit 14. For the expansion and contraction amount sensor 73, it is possible to use an LK series laser displacement meter made by Keyence, for example.

<Drying Unit>

Figure 3:
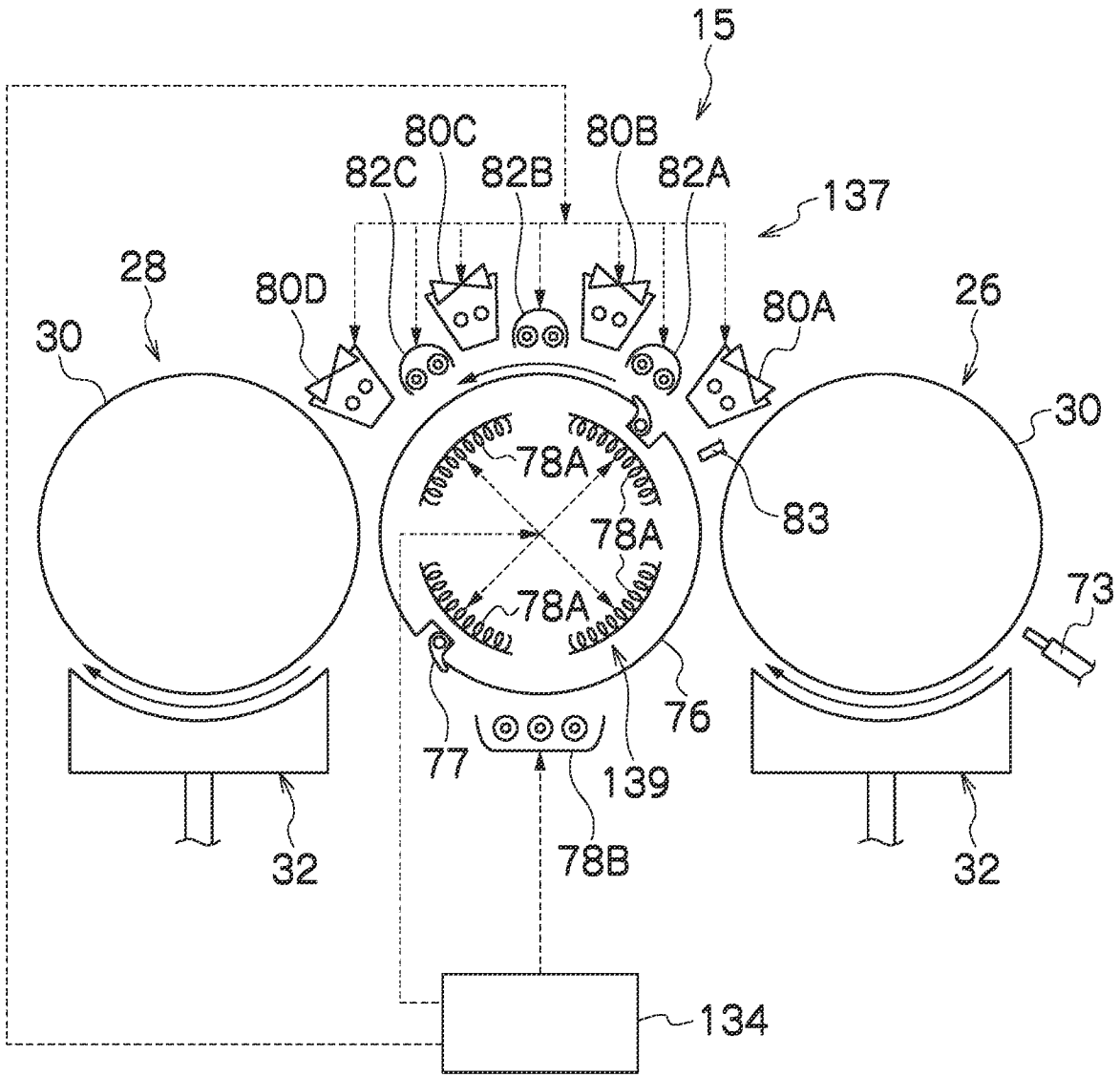
FIG. 3 is a conceptual diagram for describing a heating control system of a drying unit.

The drying unit 16 performs a step of drying water contained in the solvent that has been separated by the coloring material aggregating action. As shown in FIG. 3, the drying unit 16 includes: a drying drum 76; a double-side heating device 15, which promotes drying of the image formed on the recording surface by applying heat to both the recording surface of the recording sheet 22 and the rear surface which is opposite to the recording surface; and a drying control unit 134, which individually controls the intensities of heat applied to the recording surface and the rear surface in accordance with sheet thickness information relating to the recording sheet 22.

The double-side heating device 15 is constituted of a first heating device 137, which heats the recording surface side of the recording sheet 22, and a second heating device 139, which heats the rear surface side. The first and second heating devices 137 and 139 are connected to the drying control unit 134 through a signal cable or wireless link.

The drying drum 76 is a drum which holds the recording sheet 22 on the outer circumferential surface thereof and conveys the recording sheet 22 by rotation, and the rotational driving of this drum is controlled. The drying drum 76 has suction apertures (not shown) formed in the outer circumferential surface thereof, and has a suction device (not shown) which performs suction through the suction apertures. By this means, the recording sheet 22 is held by suction on the outer circumferential surface of the drying drum 76, and is conveyed by rotating the drying drum 76 while the leading end of the recording sheet 22 is held by the holding device 77. In this case, the recording sheet 22 is conveyed with the recording surface facing to the outer side, and the recording surface is heated by the first heating device 137. On the other hand, by conveying the recording sheet 22 with the rear surface side lying in contact with the outer circumferential surface of the drying drum 76, the rear surface side of the recording sheet 22 is heated by the second heating device 139.

An air blowing nozzle 83 is arranged on the upstream side of the first heating device 137, and the leading end portion of the recording sheet 22 conveyed while being held on the drying drum 76 by suction is thereby pressed against the drying drum 76. By this means, the recording sheet 22 makes smooth, tight contact with the outer circumferential surface of the drying drum 76.

The first heating device 137 includes a first hot air flow spraying nozzle 80A, a first IR heater 82A, a second hot air flow spraying nozzle 80B, a second IR heater 82B, a third hot air flow spraying nozzle 80C, a third IR heater 82C and a fourth hot air flow spraying nozzle 80D, which are arranged at positions facing the outer circumferential surface of the drying drum 76. By this means, the first heating device 137 is able to heat the recording surface side of the recording sheet 22 which is conveyed while being held by suction on the outer circumferential surface of the drying drum 76.

Each of the hot air flow spraying nozzles 80A to 80D is composed so as to blow a hot air flow which is controlled to a prescribed temperature (for example, 50° C. to 70° C.) toward the recording sheet 22 at a uniform air flow volume (for example, 12 $m^3$/minute). Each of the IR heaters 82A to 82C is controlled to prescribed temperature (for example, 180° C.).

The second heating device 139 includes: an electric heater 78A, which is installed inside the drying drum 76; and a rear surface IR heater 78B, which is arranged to face the outer circumferential surface of the drying drum 76 at a close position below the drying drum 76 (the position where no recording sheets 22 pass). The electric heater 78A heats the outer circumferential surface of the drying drum 76 from the interior of the drying drum 76, and the rear surface IR heater 78B heats the outer circumferential surface of the drying drum 76 from outside the drying drum 76. By this means, the second heating device 139 is able to heat the rear surface side of the recording sheet 22 which is conveyed while being held by suction on the outer circumferential surface of the drying drum 76. The heating efficiency is improved by employing the contact heating method which heats the rear surface of the recording sheet 22 by thus bringing the rear surface of the recording sheet 22 into contact with the outer circumferential surface of the drying drum 76. By this means, it is possible to improve the response and accuracy of heating control with respect to the rear surface or the recording sheet 22.

By performing double-surface heating of the recording sheet 22 with the first heating device 137 and the second heating device 139, the speed of evaporation of the water contained in the recording surface of the recording sheet 22 held on the drying drum 76 is accelerated, and drying of the recording surface is promoted. The evaporated water is expelled to the exterior of the apparatus with the air by means of an expulsion device, which is not illustrated. It is also possible that the recovered air is cooled by a cooler (radiator), or the like, and the liquid therein is recovered.

The mode of controlling the first heating device 137 by the drying control unit 134 involves, for example, turning each of the hot air flow spraying nozzles 80A to 80D on and off, adjusting the hot air flow temperature, adjusting the hot air flow volume, adjusting the number of heaters in operation in the IR heaters 82A to 82C, adjusting the switch on and off time ratio (duty control) of the IR heaters 82A to 82C, and so on.

The mode of controlling the second heating device 139 by the drying control unit 134 involves, for example, adjusting the wattage of the electric heater 78A, adjusting the number of heaters in operation in the rear surface IR heater 78B, adjusting the switch on and off time ratio (duty control) of the rear surface IR heater 78B, or the like.

In the present embodiment, the double-side heating device 15 arranged in the drying unit 16 includes the first heating device 137, which heats the recording surface side of the recording sheet 22, and the second heating device 139, which heats the rear surface side of the recording sheet 22, and the mode is described in which the role of heating the recording surface and the role of heating the rear surface of the recording sheet 22 are respectively allotted to the first and second heating devices 137 and 139. However, while the recording surface of the recording sheet 22 is not being heated by the first heating device 137, in other words, before the recording sheet 22 has been conveyed in rotation to the heating position of the first heating device 137 or after the recording sheet 22 has conveyed in rotation past the heating position, the first heating device 137 is able to heat the outer circumferential surface of the drying drum 76. Therefore, it is possible to perform the double-side heating of the recording surface side and the rear surface side of the recording sheet 22, by using only the first heating device 137 (without using the second heating device 139). This leads to energy savings.

Figure 4:
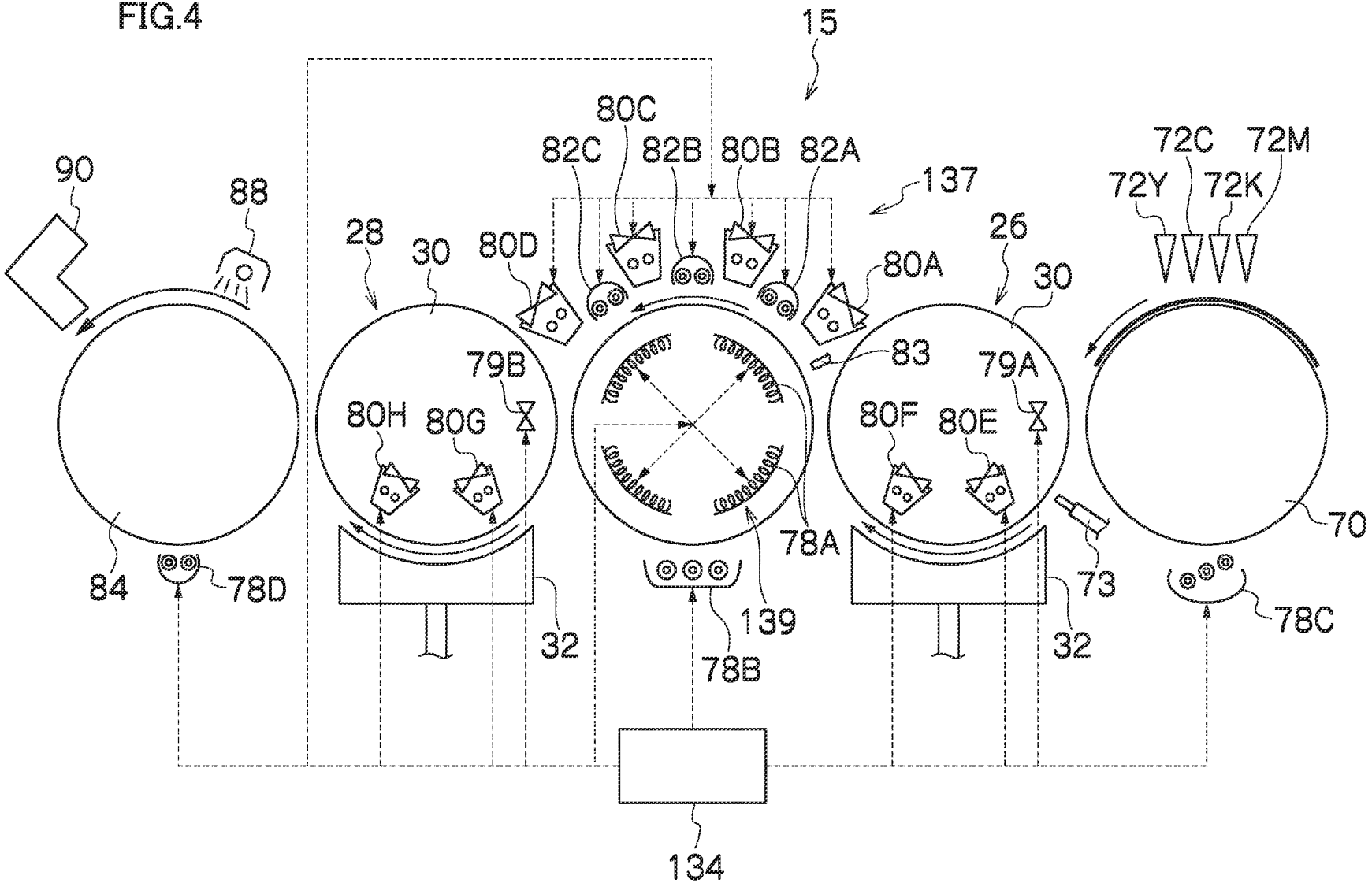
FIG. 4 is a conceptual diagram for describing a further mode of a heating control system of a drying unit.

The heating control system for the recording sheet 22 in the drying unit 16 shown in FIG. 3 is arranged only in the region of the drying unit 16; however, it is also possible to arrange the heating control system in a broad region from the image formation drum 70 to the curing drum 84 as shown in FIG. 4.

Referring to FIG. 4, the first heating device 137, which heats the recording surface side of the recording sheet 22, further includes the following heating devices, in addition to the above-described first to fourth hot air flow spraying nozzles 80A to 80D arranged about the outer circumferential surface of the drying drum 76 and the above-described first to third IR heaters 82A to 82C. More specifically, a first axial flow fan 79A, a fifth hot air flow spraying nozzle 80E and a sixth hot air flow spraying nozzle 80F are arranged following the conveyance direction of the recording sheet 22, inside the drum of the second intermediate conveyance unit 26. A second axial flow fan 79B, a seventh hot air flow spraying nozzle 80G and an eighth hot air flow spraying nozzle 80H are arranged following the conveyance direction of the recording sheet 22, inside the drum of the third intermediate conveyance unit 28. The first axial flow fan 79A and the fifth and sixth hot air flow spraying nozzles 80E and 80F are arranged in the inner space of the intermediate conveyance body 30 of the second intermediate conveyance unit 26, so as not to be coupled with the rotation of the intermediate conveyance body 30. The second axial flow fan 79B and the seventh and eighth hot air flow spraying nozzles 80G and 80H are arranged in the inner space of the intermediate conveyance body 30 of the third intermediate conveyance unit 28, so as not to be coupled with the rotation of the intermediate conveyance body 30. Each of the fifth to eighth hot air flow spraying nozzles 80E to 80H blows a hot air flow which has been heated to a prescribed temperature, through the air blowing ports 36 of the intermediate conveyance body 30, toward the conveyance guide 32. In other words, the fifth to eighth hot air flow spraying nozzles 80E to 80H heating the recording surface of the recording sheet 22 also serve as the positive pressure application devices which apply the positive pressure by blowing the air flow onto the recording surface of the recording sheet 22. The first and second axial flow fans 79A and 79B cool the recording surface of the recording sheet 22 by causing a cool air flow to strike the recording surface.

The second heating device 139, which heats the rear surface of the recording sheet 22, further includes the following heating devices, in addition to the electric heater 78A and the first rear surface IR heater 78B, which are arranged at the drying drum 76 as described above. More specifically, a second rear surface IR heater 78C is arranged so as to face the outer circumferential surface of the image formation drum 70, in a close position below the image formation drum 70 (the position where no recording sheets 22 pass), and a third rear surface IR heater 78D is arranged so as to face the outer circumferential surface of the curing drum 84, in a close position below the curing drum 84 (the position where no recording sheets 22 pass).

Thus, in addition to heating of the recording surface and heating of the rear surface of the recording sheet 22 by the drying unit 16, it is possible to assist the control of the heating intensities in the stages before and after the drying unit 16, and therefore it is possible to control heating very finely.

These additional heating devices are also connected to the drying control unit 134 through signal cables or wireless links, similarly to those described with reference to FIG. 3.

<Curing Unit>

The curing unit 18 is constituted of an ultraviolet (UV) light source 88 and an in-line sensor 90. The UV light source 88 and the in-line sensor 90 are disposed at positions facing the circumferential surface of the curing drum 84, and are arranged in sequence from the upstream side of the direction of rotation of the curing drum 84.

The curing drum 84 is a drum which holds the recording sheet 22 on the outer circumferential surface thereof and conveys the recording sheet 22 by rotation, and this drum is driven so as to rotate. The curing drum 84 has a hook-shaped holding device 85 arranged on the outer circumferential surface thereof, in such a manner that the leading end of the recording sheet 22 can be held with the holding device 85. The recording sheet 22 is conveyed by rotation due to the curing drum 84 rotating in a state where the leading end of the recording sheet 22 is held with the holding device 85. During this, the recording sheet 22 is conveyed with the recording surface thereof facing toward the outside, and the recording surface is subjected to an irradiation curing process by the UV light source 88 and inspection by the in-line sensor 90.

The UV light source 88 cures an active light-curable resin contained in the ink, thereby creating a film of the ink, by irradiating UV light onto the dried ink. For the UV light source 88, it is possible to use various ultraviolet sources, such as a metal halide lamp, a high-pressure mercury lamp, a black light, a cold cathode tube, an UV-LED, or the like.

The preferable peak wavelength of the ultraviolet light irradiated by the UV light source 88 depends on the absorption characteristics of the ink composition, and is desirably 200 nm to 600 nm, more desirably, 300 nm to 450 nm, and even more desirably 350 nm to 450 nm.

The irradiation energy of the UV light source 88 is desirably not more than 2000 mJ/cm$^2$, more desirably, 10 mJ/cm$^2$ to 2000 mJ/cm$^2$, and even more desirably, 20 mJ/cm$^2$ to 1000 mJ/cm$^2$, and especially desirably, 50 mJ/cm$^2$ to 800 mJ/cm$^2$.

In the inkjet recording apparatus 1 according to the present embodiment, the ultraviolet light is irradiated onto the recording surface of the recording sheet for, desirably, 0.01 seconds to 10 seconds, and more desirably, 0.1 seconds to 2 seconds. Moreover, the curing drum 84 may be controlled to a prescribed temperature. By this means, the curing sensitivity of the ink is raised, and the ink can be cured suitably and made into a film at a low irradiation intensity.

The in-line sensor 90 is a measurement device for measuring a test pattern, the amount of moisture, the surface temperature, the glossiness, and the like, of the image fixed on the recording sheet 22. A CCD line sensor, or the like, is employed for the in-line sensor 90.

In the present embodiment, the UV light irradiation method is used in the curing unit 18 to fix the image that has been formed on the recording surface of the recording sheet 22, but it is also possible to employ a heat roller fixing method.

The heat roller fixing method fixes an image formed on the recording sheet 22 by arranging a pair of heating rollers (not shown) of which the temperature can be controlled in a prescribed range (for example, 50° C. to 180° C.), and heating and pressing the recording sheet 22 which is pressed between the pair of heating rollers and the curing drum 84. The nip pressures of the pair of heating rollers are desirably 0.1 MPa and 1.0 MPa, respectively, and the heating temperature of the pair of heating rollers is desirably set in accordance with the glass transition temperature of the polymer micro-particles contained in the treatment liquid or the ink, or the like.

<Output Unit>

As shown in FIG. 1, the output unit 20 is arranged subsequently to the curing unit 18. The output unit 20 includes the output tray 92. A transfer drum 94, a conveyance belt 96 and a tensioning roller 98 are arranged between the output tray 92 and the curing drum 84 of the curing unit 18 so as to oppose same. The recording sheet 22 is sent to the conveyance belt 96 by the transfer drum 94 and output to and stacked in the output tray 92.

Figure 5:
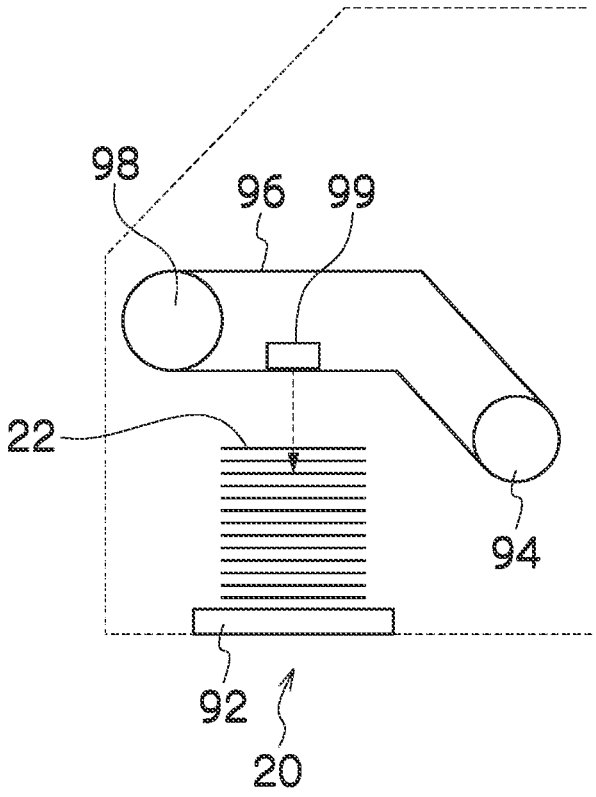
FIG. 5 is an illustrative diagram for describing a recording surface temperature sensor which is arranged in an output unit.

As shown in FIG. 5, a non-contact type of temperature sensor 99 which measures the temperature of the recording surface of the recording sheet 22 is arranged in the output unit 20. For the non-contact-type of temperature sensor 99, it is possible to use an FT series radiation temperature sensor made by Keyence, for example.

Method of Preventing Cockling and Stacker Blocking

A method for suppressing both cockling and stacker blocking by using the inkjet recording apparatus 1 having the composition described above is explained below.

Cockling is a phenomenon which occurs when cellulose fibers in the recording sheet 22 swell and deform due to the water in the aqueous ink permeating into the recording sheet 22, such as paper, and causing undulation of the image area of the recording sheet 22. Stacker blocking is a phenomenon which occurs when the recording surface temperature is too high during stacking of the recording sheets 22 in the output tray or stacker 92 of the output unit 20, or when the water content in the ink is not removed adequately due to insufficient drying of the recording surfaces of the recording sheets 22, and therefore the recording surfaces have residual stickiness and the recording sheets 22 adhere to each other.

The cockling and stacker blocking is greatly affected by the thickness of the recording sheet 22. In other words, the thinner the recording sheet 22, the lower the rigidity of the recording sheet 22, and the smaller the permeation capacity of the water content in the ink, thus making cockling more liable to occur. Conversely, if the recording sheet 22 is thick, cockling is not liable to occur, but the recording sheet 22 having a large thickness has a large heat capacity and the temperature of the recording surface of the recording sheet 22 which has risen during drying of the recording sheet 22 in the drying unit 16 does not fall readily. Hence, when the recording sheets 22 are stacked in the output tray 92 of the output unit 20, stacker blocking is liable to occur due to the stickiness of the recording surfaces of the recording sheets 22. Furthermore, since stickiness of the recording surface also arises due to insufficient drying of the recording surface, then stacker blocking occurs.

Therefore, in the present embodiment, the drying control unit 134 controls the first heating device 137 and the second heating device 139 in such a manner that the greater the thickness of the recording sheet 22, the greater the intensity of heat applied to the rear surface side of the recording sheet 22 compared to the recording surface side of the recording sheet 22. Here, the thickness of the recording sheet 22 can be expressed by the basis weight.

For example, the drying control unit 134 controls the first heating device 137 and the second heating device 139 so as to be able to switch each of the intensities of heat applied to the recording surface and the rear surface of the recording sheet 22 between three levels of "strong", "medium" and "weak". Here, the "strong" and "medium" heating intensities are set to have a temperature difference of 10° C. on the recording sheet 22, for example, and the "medium" and "weak" intensities are also set to have a temperature difference of 10° C. on the recording sheet 22, for example.

The temperature set to the recording surface side and the rear surface side of the recording sheet 22 is desirably not lower than 50° C. and more desirably, not lower than 60° C. There is no particular upper limit temperature for the recording surface side or the rear surface side, but it is necessary to set the recording surface temperature in the output unit 20 to a temperature not higher than the allowable limit temperature at which stacker blocking does not occur. Moreover, from the viewpoint of the safety of the maintenance work (preventing burns due to high temperature), such as cleaning of the ink adhered to the surface of the drying drum 76, the upper limit temperature for the recording surface and the rear surface is desirably set to not higher than 75° C. Consequently, the heating intensity described above is set to "strong", "medium" or "weak" within the temperature range described above (i.e., 50° C. to 75° C.).

For example, if the "strong" temperature is 70° C. to 75° C., then the "medium" temperature is 60° C. to 65° C., and the "weak" temperature is 50° C. to 55° C.

When the heating intensities are to be expressed by amounts of applied heat, the heating durations are also taken into consideration in addition to the above-described "strong", "medium" and "weak" heating temperatures.

If the recording sheet 22 has a small thickness and the basis weight of not more than 120 gsm, for example, then cockling is highly likely to occur, and therefore by setting the heating intensity of the recording surface and the rear surface to "strong" so as to promote drying of the recording surface, it is possible to suppress both cockling and stacker blocking. In this case, the temperature of the recording surface is measured by the temperature sensor 99 arranged in the output unit 20, and the temperature of the recording surface is controlled so as not to exceed the allowable limit temperature at which stacker blocking occurs.

If the recording sheet 22 has a relatively small thickness and the basis weight of more than 120 gsm and not more than 150 gsm, then it is possible to suppress both cockling and stacker blocking by means of a combination of the "strong" heating intensity for the recording surface and the "strong" heating intensity for the rear surface, a combination of the "strong" heating intensity for the recording surface and the "medium" heating intensity for the rear surface, or a combination of the "medium" heating intensity for the recording surface and the "strong" heating intensity for the rear surface.

If the recording sheet 22 has a relatively large thickness and the basis weight of more than 150 gsm and not more than 180 gsm, then it is possible to suppress both cockling and stacker blocking by means of a combination of the "medium" heating intensity for the recording surface and the "strong" heating intensity for the rear surface, or a combination of the "weak" heating intensity for the recording surface and the "strong" heating intensity for the rear surface.

If the recording sheet 22 has a large thickness and the basis weight of more than 180 to gsm and not more than 270 gsm, then it is possible to suppress both cockling and stacker blocking by means of a combination of the "weak" heating intensity for the recording surface and the "strong" heating intensity for the rear surface.

If the recording sheet 22 is even thicker and has the basis weight of more than 270 gsm, then no cockling occurs at all, but since stacker blocking is liable to arise as a result of insufficient drying, it is necessary to set the "strong" heating intensity for the recording surface, and it is also necessary to promote heating by setting the heating intensity to "medium" or "strong" for the rear surface.

As can be seen from these, if the recording sheet 22 has a small thickness, cockling is liable to occur, and therefore it is important to suppress both cockling and stacker blocking by setting the "strong" heating intensity for the recording surface so as to promote drying of the recording surface, as well as controlling the heating intensity for the rear surface in the range of "medium" to "strong" so as to assist the promotion of drying of the recording surface, without allowing the temperature of the recording surface to rise excessively.

The greater the thickness of the recording sheet 22, the less liable cockling is to occur, but as the recording sheet becomes thicker, the thermal capacity thereof becomes greater, the temperature set in the drying unit 16 falls less readily, and therefore stacker blocking becomes more likely to occur. Consequently, in this case, both cockling and stacker blocking can be suppressed by controlling the heating intensity for the rear surface to "strong" so as to prevent insufficient drying, while restricting the heating intensity for the recording surface.

Moreover, if the recording sheet 22 is relatively thick and has the basis weight of not less than 270 gsm, then although there is no concern regarding cockling, stacker blocking is liable to occur due to insufficient drying, and therefore it is important to raise the heating intensity for the rear surface so as to avoid insufficient drying, while restricting the heating intensity for the recording surface.

Furthermore, another factor which must be taken into account for suppressing cockling, other than the thickness of the recording sheet 22, is the deposition volume of aqueous ink, and the greater the ink deposition volume, the greater the volume of water from the ink which permeates into the recording sheet 22, and hence the more liable cockling is to occur. Consequently, if the ink deposition volume is large, then it is necessary to promote drying by making the heating temperature of the recording surface of the recording sheet 22 as high as possible, in order to suppress cockling, but if the heating temperature becomes too high, then stacker blocking occurs as described above.

As a countermeasure against this, it is desirable that the inkjet recording apparatus 1 includes a ROM 145 (see FIG. 6) as a storage unit in which a table of correspondences between the deposition volume of aqueous ink and the allowable limit temperature of the recording surface of the recording sheet 22 after drying is previously stored for each recording sheet type that corresponds to the thickness of the recording sheet 22, and a data input unit 135 (see FIG. 6) through which data concerning a recording sheet type and an ink deposition volume are input. The drying control unit 134 controls the first heating device 137 and the second heating device 139 independently so as not to exceed the allowable limit temperature of the recording surface which is selected from the correspondence table on the basis of the input recording sheet type and ink deposition volume.

By this means, it is possible to heat the recording surface to the highest temperature at which stacker blocking is avoided, and hence the occurrence of stacker blocking in the output unit 20 can be suppressed while promoting drying of the recording surface in such a manner that cockling does not occur.

The correspondence table is created in advanced by preliminary testing, or the like. The recording sheet thickness of each type of recording sheet 22 can be expressed by the basis weight. It is also possible for the ink deposition volume data to be automatically obtained from the image data in a memory 144 or from ink ejection data (dot data) generated by a print controller 124, even if the data of the ink deposition volume is not input through the data input unit 135.

In this case, the drying control unit 134 is able to raise the recording surface temperature to the limit at which stacker blocking does not occur, by actually measuring the recording surface temperature with the non-contact-type of temperature sensor 99 arranged in the output unit 20, and therefore stacker blocking can be suppressed while maintaining drying performance effectively.

When using the correspondence table described above, the allowable limit temperature of the recording surface of the recording sheet 22 after drying is inevitably set to an allowable limit temperature slightly lower than the highest temperature to allow a margin of safety, but by actually measuring the recording surface temperature with the non-contact-type of temperature sensor 99, it is possible to set the recording surface temperature to the highest limit temperature at which stacker blocking does not occur.

Cockling occurs due to the expansion and deformation of the cellulose fibers as a result of permeation of the aqueous ink into the recording sheet 22, and the actual amount of expansion of the cellulose fibers varies depending on the ambient temperature and humidity conditions in which the inkjet recording apparatus 1 is used. For example, during rainy or wet season, the recording sheet 22 has absorbed moisture and expanded to some extent before the aqueous ink is deposited thereon, which means that the rate of expansion upon deposition of ink becomes smaller. Conversely, in dry season, the recording sheet 22 has dried out, and therefore the rate of expansion upon deposition of ink becomes larger. The temperature and humidity conditions of the inkjet recording apparatus 1 can be changed not only with seasonal variations but also with air conditioning in the room where the inkjet recording apparatus 1 is situated.

Hence, it is desirable that the amount of expansion and contraction of the recording sheet 22 after the deposition of aqueous ink is measured by means of the expansion and contraction amount sensor 73 arranged between the image formation unit 14 and the drying unit 16, and the drying control unit 134 controls the heating intensities for the recording surface and the rear surface while taking the measurement results into consideration. For example, the dimensions (length and width) of the recording sheet 22 when setting the heating intensities "strong", "medium" and "weak" described above are taken as reference values, and if the measured dimensions of the recording sheet 22 are greater than the reference values, then this means that the recording sheet 22 is being used under conditions where cockling is not liable to occur, and therefore the heating intensity for the recording surface is weakened compared to when the reference values were taken. Conversely, if the measured dimensions of the recording sheet 22 are smaller than the reference values, then this means that the recording sheet 22 is being used under conditions where cockling is liable to occur, and therefore the heating intensity for the recording surface is made stronger than when the reference values were taken.

By this means, it is possible to suppress cockling accurately, irrespective of the ambient temperature and humidity conditions in which the inkjet recording apparatus 1 is used.

In the present embodiment, since the treatment liquid deposition unit 12 is arranged before the image formation unit 14 in such a manner that the aqueous ink deposited on the recording sheet 22 is aggregated and the viscosity of the ink rises swiftly, then it is possible to further suppress the occurrence of cockling and stacker blocking. Moreover, since the curing unit 90 which cures the ink on the recording surface of the recording sheet 22 is arranged after the drying unit 16, then stacker blocking can be made even less liable to occur.

In the present embodiment, the inkjet recording apparatus 1 in which an image is formed on one surface of the recording sheet 22 has been described, but the present invention can also be applied to a case of double-side printing in which two compositions from the treatment liquid deposition unit 12 through the curing unit 18 are arranged in series. More specifically, in the case of double-side printing for forming images on both surfaces of the recording sheet 22, ink deposition is performed onto the rear surface of the recording sheet 22 in which cockling has occurred due to the ink deposition on the front surface, and therefore the recording sheet 22 may make contact with the ink ejection heads. In this case, the present invention is even more effective.

<Description of Control System>

Figure 6:
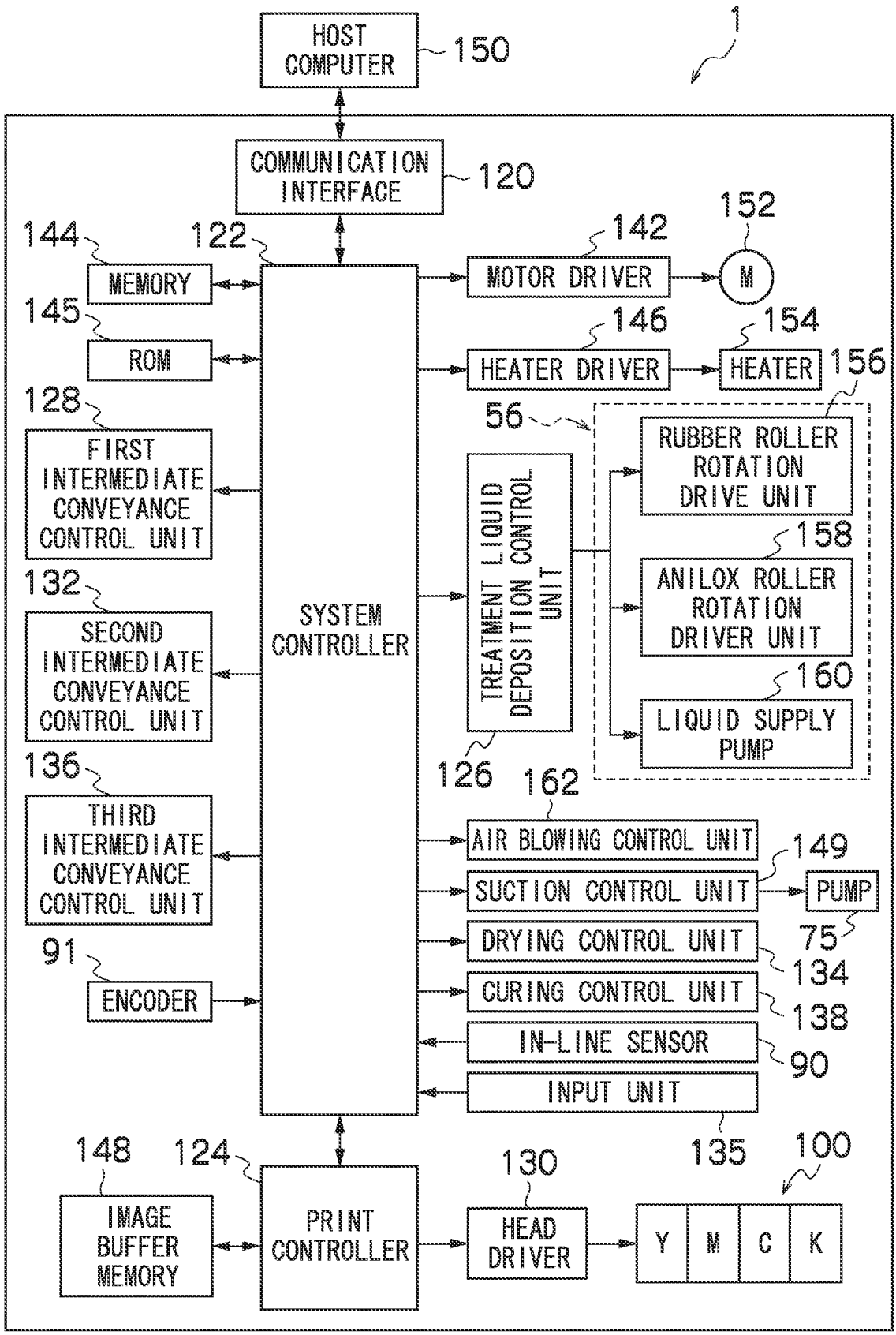
FIG. 6 is a principal block diagram showing the system composition of the inkjet recording apparatus.

FIG. 6 is a principal block diagram showing the system composition of the inkjet recording apparatus 1. The inkjet recording apparatus 1 includes a communication interface 120, a system controller 122, a print controller 124, a treatment liquid deposition control unit 126, a first intermediate conveyance control unit 128, a head driver 130, a second intermediate conveyance control unit 132, a drying control unit 134, a third intermediate conveyance control unit 136, a fixing control unit 138, an in-line sensor 90, an encoder 91, the data input unit 135, a motor driver 142, the memory 144, the ROM 145, a heater driver 146, an image buffer memory 148, a suction control unit 149, an air blowing control unit 162, and the like.

The communication interface 120 is an interface unit for receiving image data which is transmitted by a host computer 150. For the communication interface 120, a serial interface, such as USB (Universal Serial Bus), IEEE 1394, an Ethernet, or a wireless network, or the like, or a parallel interface, such as a Centronics interface, or the like, can be used. It is also possible to install a buffer memory (not shown) for achieving high-speed communications. Image data sent from the host computer 150 is read into the inkjet recording apparatus 1 through the communication interface 120, and is stored temporarily in the memory 144.

The system controller 122 is constituted of a central processing device (CPU) and a peripheral circuit thereof, and the like, and functions as a control device which controls the whole of the inkjet recording apparatus 1 in accordance with prescribed programs, as well as functioning as a calculation device which performs various calculations. In other words, the system controller 122 controls the respective units, such as the communication interface 120, the treatment liquid deposition control unit 126, the first intermediate conveyance unit 128, the head driver 130, the second intermediate conveyance unit 132, the drying control unit 134, the third intermediate conveyance unit 136, the fixing control unit 138, the memory 144, the motor driver 142, the heater driver 146, the suction control unit 149, the air blowing control unit 162, and the like, as well as controlling communications with the host computer 150, controlling reading from and writing to the memory 144, and also generating control signals which control motors 152 and heaters 154 of the conveyance system.

The memory 144 is a storage device which temporarily stores the image data input through the communication interface 120, and the data is read from and written to the memory 144 through the system controller 122. The memory 144 is not limited to a memory constituted of semiconductor devices, and may also employ a magnetic medium, such as a hard disk.

Programs to be executed by the CPU of the system controller 122 and various data required for control purposes are stored in the ROM 145 (storage unit). As one element of the various data, the correspondence table for the deposition volume of the aqueous ink and the allowable limit temperature of the recording surface after drying is stored previously for each type of recording sheet corresponding to a thickness of the recording sheet 22. The recording sheet thickness (paper basis weight) for each type of recording sheet, the deposition volume of the aqueous ink, and the allowable limit temperature of the recording surface after drying are input through the data input unit 135. The deposition volume of the aqueous ink may be automatically obtained from the image data stored in the memory 144, or the ink ejection data (dot data) which is generated by the print controller 124.

The ROM 145 may be a non-rewriteable storage device, or may be a rewriteable storage device such as an EEPROM. The memory 144 is used as a temporary storage area for image data and also serves as a development area for programs and a calculation work area for the CPU.

The motor driver 142 drives the motors 152 in accordance with instructions from the system controller 122. In FIG. 6, the motors arranged in the respective units of inkjet recording apparatus 1 are denoted with the reference numeral 152. For example, the motors 152 shown in FIG. 6 include motors which drive the rotation of the first transfer drum 52, the treatment liquid drum 54, the image formation drum 70, the drying drum 76, the curing drum 84, the transfer drum 94, and the like, a drive motor of the pump 75 for producing a negative pressure through the suction apertures of the image formation drum 70, a motor of a withdrawal mechanism of the head units of the inkjet heads 72C, 72M, 72Y and 72K, or the like as shown in FIG. 1.

The heater driver 146 drives the heaters 154 in accordance with instructions from the system controller 122. In FIG. 6, the heaters arranged in the respective units of inkjet recording apparatus 1 are denoted with the reference numeral 154. For example, the heaters 154 shown in FIG. 6 include a pre-heater (not shown) for previously heating the recording sheet 22 to a suitable temperature in the recording sheet feed unit 10, and the like.

The print controller 124 is a control unit which has signal processing functions for carrying out processing, correction, and other treatments in order to generate a droplet ejection control signal on the basis of the image data in the memory 144, in accordance with the control of the system controller 122, and which supplies the droplet ejection data (dot data) thus generated to the head driver 130. Prescribed signal processing is carried out in the print controller 124, and the ejection volume and the ejection timing of the ink droplets in an inkjet head 100 (corresponding to the inkjet heads 72M, 72K, 72C and 72Y shown in FIG. 1) are controlled through the head driver 130 on the basis of the image data. By this means, a desired dot size and dot arrangement are achieved.

The print controller 124 is provided with the image buffer memory 148, and data such as image data and parameters, is stored temporarily in the image buffer memory 148 during processing of the image data in the print controller 124. In FIG. 6, the image buffer memory 148 is depicted as being attached to the print controller 124, but may be combined with the memory 144. It is also possible that the print controller 124 and the system controller 122 are integrated to form a single processor.

To give a general description of the processing from image data input until droplet ejection data output, the image data that is to be printed is input through the communication interface 120 from an external source and is stored in the memory 144. At this stage, for example, RGB image data is stored in the memory 144.

In the inkjet recording apparatus 1, an image having tones which appear continuous to the human eye is formed by altering the deposition density and size of fine dots of ink (coloring material), and therefore it is necessary to convert the tones of the input digital image (light/dark density of the image) into a dot pattern which reproduces the tones as faithfully as possible. Then, the data of the original image (RGB) stored in the memory 144 is sent to the print controller 124 through the system controller 122, and is converted into dot data for each ink color by a half-toning process using a threshold value matrix, error diffusion, or the like, in the print controller 124.

In other words, the print controller 124 carries out processing for converting the input RGB image data into dot data for the four colors of K, C, M and Y. The dot data thus generated by the print controller 124 is stored in the image buffer memory 148.

The head driver 130 outputs drive signals for driving actuators corresponding to respective nozzles of the inkjet head 100 on the basis of the droplet ejection data supplied from the print controller 124 (in other words, dot data stored in the image buffer memory 148). The head driver 130 may also incorporate a feedback control system for maintaining uniform drive conditions in the inkjet head 100.

By applying the drive signal output from the head driver 130 to the inkjet head 100, ink is ejected from the corresponding nozzles of the inkjet head 100. An image is formed on the recording sheet 22 by controlling ink ejection from the inkjet head 100 while conveying the recording sheet 22 at a prescribed speed.

Furthermore, the system controller 122 controls the treatment liquid deposition control unit 126, the first intermediate conveyance control unit 128, the second intermediate conveyance control unit 132, the drying control unit 134, the third intermediate conveyance control unit 136, the fixing control unit 138, the suction control unit 149 and the air blowing control unit 162.

The treatment liquid deposition control unit 126 controls the operation of the treatment liquid application device 56 of the treatment liquid deposition unit 12 in accordance with instructions from the system controller 122.

The first intermediate conveyance control unit 128 controls the operation of the intermediate conveyance body 30 of the first intermediate conveyance unit 24 in accordance with instructions from the system controller 122. More specifically, the first intermediate conveyance control device 128 controls the driving of the rotation of the intermediate conveyance body 30, and the rotation of the holding devices which are arranged on the intermediate conveyance body 30, and the like. The second intermediate conveyance control unit 132 and the third intermediate conveyance control unit 136 also perform similar control to the first intermediate conveyance control unit 128.

The drying control unit 134 suppresses cockling and stacker blocking by controlling the first heating device 137 and the second heating device 139 so as to control the heating intensities for the recording surface and the rear surface of the recording sheet 22, on the basis of the correspondence table stored in the ROM 145. Moreover, the drying control unit 134 controls the heating intensities for the recording surface and the rear surface of the recording sheet 22 on the basis of data obtained from the temperature sensor 99 arranged in the output unit 20 and the expansion and contraction amount sensor 73 arranged between the image formation unit 14 and the drying unit 16, thereby suppressing cockling and stacker blocking.

The suction control unit 149 and the air blowing control unit 162 control the suction device and the air blowing device 83 which are arranged inside the drying drum 76 in accordance with control implemented by the system controller 122, in order to convey the recording sheet 22 on which an image has been formed in a state of tightly held on the drying drum 76. In the suction device and the air blowing device 83, the suction start position by the suction device and the air blowing position by the air blowing device 83 are controlled in accordance with the rigidity of the recording sheet 22. The suction start position control by the suction control unit 149 can be implemented by operating the pump 75 when the recording sheet 22 has passed the suction start position. The suction force produced by the suction device and the pressing force (air flow pressure) produced by the air blowing device are controlled in accordance with the type of recording sheet 22. The suction force and the pressing force corresponding to the rigidity of the recording medium are stored in the ROM 145, and control can be implemented by directly inputting the type of recording sheet 22 used, through a PC (not shown).

Moreover, the suction force produced by the suction device and the pressing force (air flow pressure) produced by the air blowing device are controlled on the basis of the image data in the memory 144 or the droplet ejection data (dot data) generated by the print controller 124. Furthermore, the suction force and the pressing force (air flow pressure) are controlled in the width direction of the recording sheet 22.

Ink Composition

The ink composition in the present embodiment includes a pigment, and can be composed by also using a dispersant, a surfactant, and other components, according to requirements. In the present embodiment, in order to improve the durability of the image, it is also possible to make the ink less liable to wet and spread on the recording medium by raising the viscosity or surface tension of the ink liquid. For example, of the components listed below, it is desirable to increase the dispersed particle components, such as pigment or resin particles, since this not only increases the viscosity of the ink liquid, but also speeds up aggregation and can be expected to enhance the strength of the actual aggregate body.

<Pigment>

The ink composition in the present embodiment contains at least one type of pigment as a coloring material component. There are no particular restrictions on the pigment, and it is possible to select a pigment appropriately according to the object, for example, the pigment may be an organic or inorganic pigment. It is desirable from the viewpoint of ink coloring properties that the pigment should be one which is virtually insoluble or has poor solubility in water.

<Dispersant>

The ink composition according to the present embodiment may include at least one type of dispersant. As the pigment dispersant, it is possible to use either a polymer dispersant or a low-molecular-weight surfactant. Furthermore, the polymer dispersant may be a water-soluble dispersant or a water-insoluble dispersant.

The weight-average molecular weight of the polymer dispersant is desirably 3,000 to 100,000, more desirably, 5,000 to 50,000, yet more desirably, 5,000 to 40,000, and especially desirably, 10,000 to 40,000.

The acid value of the polymer dispersant is desirably not more than 100 mg KOH/g, from the viewpoint of achieving good aggregating properties upon making contact with the treatment liquid. Furthermore, the acid value is more desirably 25 to 100 mg KOH/g, yet more desirably, 25 to 80 mg KOH/g, and especially desirably, 30 to 65 mg KOH/g. If the acid value of the polymer dispersant is no less than 25 mg KOH/g, then the self-dispersing properties thereof have good stability.

From the viewpoint of self-dispersing properties and the aggregation speed upon contact with the treatment liquid, the polymer dispersant desirably includes a polymer having a carboxyl group, and more desirably includes a polymer having a carboxyl group and an acid value of 25 to 80 mg KOH/g.

In the present embodiment, from the viewpoint of the lightfastness and the quality of the image, and the like, desirably, a pigment and a dispersant are included, more desirably, an organic pigment and a polymer dispersant are included, and especially desirably, an organic pigment and a polymer dispersant having a carboxyl group are included. Moreover, from the viewpoint of aggregating properties, desirably, the pigment is coated with a polymer dispersant having a carboxyl group and water-insoluble. Furthermore, from the viewpoint of aggregating properties, desirably, the acid value of the self-dispersing polymer particles which are described hereinafter is smaller than the acid value of the polymer dispersant.

The average particle size of the pigment is desirably 10 to 200 nm, more desirably, 10 to 150 nm, and yet more desirably, 10 to 100 nm. Good color reproduction and good droplet ejection characteristics when ejecting by an inkjet method are obtained if the average particle size is no greater than 200 nm, and good lightfastness is obtained if the average particle size is no less than 10 nm. Moreover, there are no particular restrictions on the particle size distribution of the coloring material, and it is possible to have a broad particle size distribution or a mono-disperse particle size distribution. Furthermore, it is also possible combine and use two or more types of coloring material having a mono-disperse particle size distribution.

The average particle size and the particle size distribution of the pigment particles are determined by measuring the volume-average particle size by dynamic light scattering using a UPA-EX150 Nanotrac particle size analyzer (made by Nikkiso).

The pigments may be used independently, or two or more types of pigment may be used in combination.

From the viewpoint of image density, the content of the pigment in the ink composition is desirably, 1 to 25 wt %, more desirably, 2 to 20 wt %, yet more desirably, 5 to 20 wt %, and especially desirably, 5 to 15 wt %, with respect to the ink composition.

<Polymer Particles>

The ink component of the present embodiment may include polymer particles of at least one type. The polymer particles have a function of solidifying the ink composition by destabilizing dispersion upon contact with the treatment liquid or the area where the treatment liquid has dried, causing aggregation and leading to increase in the viscosity of the ink, and hence making it possible to further improve the fixing properties of the ink composition onto the recording medium and the wear resistance of the image.

In order to react with the aggregating agent, polymer particles having an anionic surface charge can be used, and a commonly known latex can be used provided that adequate reactivity and ejection stability can be obtained, but it is especially desirable to use self-dispersing polymer particles.

<Self-Dispersing Polymer Particles>

Desirably, the ink composition in the present embodiment includes at least one type of self-dispersing polymer particles as the polymer particles. The self-dispersing polymer particles have a function of solidifying the ink composition by destabilizing dispersion upon contact with the treatment liquid or the area where the treatment liquid has dried, causing aggregation and leading to increase in the viscosity of the ink, and hence making it possible to further improve the fixing properties of the ink composition onto the recording medium and the wear resistance of the image. Furthermore, the self-dispersing polymer constituted of resin particles is desirable from the viewpoint of the ejection stability and the stability of the liquid composition containing the pigment (and in particular, dispersion stability).

Self-dispersing polymer particles means particles of a water-insoluble polymer which does not contain free emulsifier and which can be obtained as a dispersion in an aqueous medium due to a functional group (particularly, an acid group or salt thereof) contained in the polymer itself, without the presence of a separate surfactant.

The acid value of the self-dispersing polymer in the present invention is desirably no more than 50 KOH mg/g, from the viewpoint of achieving good aggregating properties upon making contact with the treatment liquid. Moreover, the acid value is more desirably 25 to 50 KOH mg/g, and even more desirably, 30 to 50 KOH mg/g. If the acid value of the self-dispersing polymer is no less than 25 KOH mg/g, then the self-dispersing properties thereof have good stability.

From the viewpoint of self-dispersion properties and the aggregation speed upon contact with the treatment liquid, the particles of self-dispersing polymer according to the present invention desirably include a polymer having a carboxyl group, more desirably include a polymer having a carboxyl group and an acid value of 25 to 50 KOH mg/g, and even more desirably include a polymer having a carboxyl group and an acid value of 30 to 50 KOH mg/g.

As regards the molecular weight of the water-insoluble polymer which constitutes the self-dispersing polymer particles, a weight-average molecular weight of 3,000 to 200,000 is desirable, 5,000 to 150,000, more desirable, and 10,000 to 100,000, even more desirable. By having a weight-average molecular weight of no less than 3,000, it is possible to restrict the amount of water-soluble component effectively. Furthermore, by having a weight-average molecular weight of no more than 200,000, it is possible to improve the self-dispersion stability.

The weight-average molecular weight is measured by gel permeation chromatography (GPC). The GPC is carried out using an HLC-8220 GPC device (made by Tosoh) and three columns, a TSK gel Super HZM-H, TSK gel Super HZ4000, TSK gel Super HZ2000 (product names of Tosoh Corp., 4.6 mm ID by 15 cm), with an eluent of THF (tetrahydrofuran). The chromatography conditions are: sample density 0.35/min, flow rate 0.35 ml/min, sample inlet amount 10 μl, and measurement temperature 40° C. An IR detector is used. A calibration curve is created from eight samples manufactured by Tosoh: "standard sample TSK standard, polystyrene": "F-40", "F-20", "F-4", "F-1", "A-5000", "A-2500", "A-1000" and "n-propyl benzene".

The average particle size of the self-dispersing polymer particles is desirably in the range of 10 to 400 nm, more desirably in the range of 10 to 200 nm, and even more desirably, in the range of 10 to 100 nm, as a volume-average particle size. If the volume-average particle size is not smaller than 10 nm, manufacturability is improved and if the volume-average particle size is not larger than 1 μm, then storage stability is improved.

The average particle size and the particle size distribution of the particles of self-dispersing polymer are determined by measuring the volume-average particle size by dynamic light scattering using a UPA-EX150 Nanotrac particle size analyzer (made by Nikkiso).

The particles of self-dispersing polymer used may be of one type only or a combination of two or more types. The content of the self-dispersing polymer particles in the ink composition is desirably 1 to 30 wt % and more desirably 5 to 15 wt % with respect to the ink composition, from the viewpoint of the aggregation speed and the image luster, and so on.

Furthermore, the content ratio between the pigment and the self-dispersing polymer particles in the ink composition (for example, the ratio of water-insoluble pigment particles/self-dispersing polymer particles) is desirably 1/0.5 to 1/10 and more desirably 1/1 to 1/4, from the viewpoint of the wear resistance of the image, and the like.

<Polymerizable Compound>

The ink composition according to the present embodiment may include at least one type of water-soluble polymerizable compound which is polymerized by an active energy beam.

Water-soluble means that the compound can be dissolved to a prescribed density or above in water, and the compound should be dissolvable in an aqueous ink (and desirably in a uniform fashion). Furthermore, the compound may also be dissolved in the ink (desirably in a uniform fashion), by raising the solubility through the addition of a water-soluble organic solvent, which is described hereinafter. More specifically, the solubility of the compound with respect to water is desirably not less than 10 wt % and more desirably, not less than 15 wt %.

From the viewpoint of impeding reaction between the aggregating agent, the pigment and the polymer particles, the polymerizable compound is desirably an anionic or cationic polymerizable compound and preferably is a polymerizable compound having a solubility of not less than 10 wt % (and more desirably, not less than 15 wt %) with respect to water.

From the viewpoint of raising resistance to wear, the polymerizable compound of the present embodiment is desirably a polyfunctional monomer, preferably a bifunctional to a hexafunctional monomer, and from the viewpoint of achieving both solubility and wear resistance, a bifunctional to a tetrafunctional monomer.

It is possible to include only one type or a combination of two or more types of polymerizable compound.

The content of the polymerizable compound in the ink composition is desirably 30 to 300 wt % and more desirably 50 to 200 wt %, with respect to the total solid content of the pigment plus the self-dispersing polymer particles. If the content of the polymerizable compound is not less than 30 wt %, then the image strength is improved and excellent wear resistance of the image is obtained, whereas if the content is not more than 300 wt %, then an advantage is obtained in terms of pile height.

<Initiator>

The ink composition according to the present embodiment may also contain at least one type of initiator which initiates polymerization of the polymerizable compound by an active energy beam, either in addition to the treatment liquid described below or in the absence of the treatment liquid. A photopolymerization initiator may be used, either one type only or a combination or two or more types, and may be used conjointly with a sensitizing agent.

The initiator may include a suitably selected compound which is capable of starting a polymerization reaction by application of an active energy beam; for example, it is possible to use an initiator (a photo initiator) which creates an active species (radical, acid, base, or the like) upon application of a beam of radiation, light or an electron beam.

If an initiator is included, than the content of the initiator with respect to the ink composition is desirably 1 to 40 wt %, and more desirably, 5 to 30 wt %, with respect to the polymerizable compound. If the content of the initiator is not less than 1 wt %, then the wear resistance of the image is further improved, which is advantageous in the case of high-speed recording, and if the content of the initiator is not more than 40 wt %, then an advantage in terms of ejection stability is obtained.

<Water-Soluble Organic Solvent>

The ink composition according to the present embodiment may include at least one type of water-soluble organic solvent. A water-soluble organic solvent can obtain beneficial effects in preventing drying, lubricating or promoting permeation. In order to prevent drying, the solvent is used as an anti-drying agent which prevents blockages caused by ink adhering to the ink ejection ports of the ejection nozzles and drying to form aggregate material, and in order to prevent drying and achieve lubrication, a water-soluble organic solvent having a lower vapor pressure than water is desirable. Furthermore, in order to promote permeation, the solvent can be used as a permeation promoter which raises the permeability of the ink into the recording sheet.

A water-soluble organic solvent having a lower vapor pressure than water is desirable as an anti-drying agent.

It is possible to use only one type or a combination of two or more types of anti-drying agent. The content of the anti-drying agent is desirably in the range of 10 to 50 wt % in the ink composition.

A water-soluble organic solvent is suitable as a permeation promoter with the object of causing the ink composition to permeate more readily into the recording medium (printing paper, or the like). It is possible to use only one type or a combination of two or more types of permeation promoter. The content of the permeation promoter is desirably in the range of 5 to 30 wt % in the ink composition. Furthermore, the permeation promoter is desirably used in a weight range that does not cause image bleeding or print through.

<Water>

The ink composition includes water, and there are no particular restrictions on the amount of water. However, a desirable content of water is 10 to 99 wt %, more desirably, 30 to 80 wt %, and even more desirably, 50 to 70 wt %.

<Other Additives>

The ink composition of the present embodiment can be composed by using other additives apart from the components described above. The other additives may be commonly known additives, for example, an anti-drying agent (humidifying agent), an anti-fading agent, an emulsion stabilizer, a permeation promoter, an ultraviolet light absorber, an antibacterial agent, an antiseptic agent, a pH adjuster, a surface tension adjuster, an antifoaming agent, a viscosity adjuster, a dispersant, a dispersion stabilizer, an anti-rusting agent, a chelating agent, or the like.

Treatment Liquid

The treatment liquid includes at least an aggregating agent which aggregates the components in the ink composition described above, and may also be composed by using other components according to requirements. By using a treatment liquid in addition to an ink composition, it is possible to raise the speed of inkjet recording, and an image having excellent definition (reproducibility of fine lines and intricate detail portions) with good density and high resolution is obtained even in a case of recording at a high speed. Furthermore, by improving the preparation of the treatment liquid and the ink composition, it is possible to raise the strength of the actual image formed, and hence the durability of the image with respect to high-pressure air blowing, and the like, can be enhanced.

The aggregating agent used may be a compound capable of changing the pH of the ink composition, or a multivalent metal salt, or a polyallyl amine. In the present invention from the viewpoint of the aggregating properties of the ink composition, a compound capable of changing the pH of the ink composition is desirable, and a compound capable of lowering the pH of the ink composition is more desirable.

In the present embodiment, it is desirable to choose an aggregating agent that is capable of rapidly separating the solid component from the carrying component (the liquid component) after aggregation, or making the aggregate material itself more rigid. For an aggregating agent of this kind, an organic acid is desirable, a bifunctional or higher organic acid is desirable, and a bifunctional or higher and trifunctional or lower acid material is especially desirable. As a bifunctional or higher organic acid, an organic acid having a first pKa of not more than 3.5 is desirable, and an organic acid having a first pKa of not more than 3.0 is more desirable. More specifically, suitable examples of this acid are: phosphoric acid, oxalic acid, malonic acid, citric acid, and the like.

The aggregating agent used may be of one type only or a combination of two or more types.

The content ratio of the aggregating agent which aggregates the ink composition in the treatment liquid is desirably, 1 to 50 wt %, more desirably, 3 to 45 wt % and even more desirably 5 to 40 wt %.

The treatment liquid may include other additives as further components, provided that this does not impair the beneficial effects of the present invention. The other additives may be commonly known additives, for example, an anti-drying agent (humidifying agent), an anti-fading agent, an emulsion stabilizer, a permeation promoter, an ultraviolet light absorber, an antibacterial agent, an antiseptic agent, a pH adjuster, a surface tension adjuster, an antifoaming agent, a viscosity adjuster, a dispersant, a dispersion stabilizer, an anti-rusting agent, a chelating agent, or the like.

Recording Medium

The inkjet recording method according to the present embodiment records an image on a recording medium.

There are no particular restrictions on the recording medium, but it is possible to use general printing papers that are used in normal offset printing, or the like, and whose main component is cellulose, such as so-called high-grade paper, coated paper, art paper, or the like. General printing papers having cellulose as a main component display relatively slow ink absorption and drying in image recording using a standard inkjet method which employs aqueous ink, so movement of the coloring material is liable to occur after ink droplet deposition and image quality is liable to decline. However, if the inkjet recording method according to the present embodiment is employed, then movement of the coloring material is suppressed and high-quality image recording having excellent color density and color hues can be achieved.

Of recording media, so-called coated paper which is used in general offset printing, and the like are desirable. Coated paper is high-grade or medium-grade paper principally made of cellulose and not generally having a surface treatment, which has a coating layer provided on the surface thereof by applying a coating material. Coated paper is liable to produce problems of image quality, such as the image luster and wear resistance, and the like, in image formation using a standard aqueous inkjet method, but in the image recording method according to the present embodiment, non-uniformities in luster are suppressed and it is possible to obtain an image having good luster and wear resistance. In particular, it is desirable to use a coated paper having a base paper and a coating layer including an inorganic pigment, and it is more desirable to use a coated paper having a base paper and a coating layer including kaolin and/or calcium bicarbonate. More specifically, art paper, coated paper, lightweight coated paper or fine coated paper are more desirable.

EXAMPLES

The present invention is described in more specific terms below with reference to examples but the present invention is not limited to these examples.

In the experiment, the extent of suppression of the cockling and stacker blocking was investigated by controlling the heating intensities for the recording surface and the rear surface of the recording sheet in accordance with the thickness of the recording sheet, by using the inkjet recording apparatus including the drying unit shown in FIG. 3.

A table in FIG. 7 shows the experiment conditions and results.

<Types of Recording Sheets Used in Experimentation>

As shown in the table in FIG. 7, sheets of recording media having five different basis weights as indicated below are used in the experiment.

OK Top Coat: Basis weight 104 gsm

OK Top Coat: Basis weight 127 gsm

OK Top Coat: Basis weight 157 gsm

Ibest: Basis weight 210 gsm

Ibest: Basis weight 310 gsm

<Treatment Liquid Deposition Conditions of Treatment Liquid Deposition Unit>

The treatment liquid application device applied the treatment liquid at 1.7 $g/m^2$ to the recording surface of each recording sheet, using the roller system which was explained in the treatment liquid deposition unit described above. The treatment liquid deposition conditions were the same for all five types of recording media.

<Image Forming Conditions of the Image Formation Unit)

The ink used had the following composition: pigment: 5 wt %; aqueous UV monomer: 20 wt %; initiator: 3 wt %; pigment dispersant: 1.5 wt %; surfactant: 1 wt %; and ultra-pure water: remainder.

A stripe image was formed on the recording surface of each recording sheet under image formation conditions of average ink droplet volume of 5 pl and resolution of 1200 dpi by 1200 dpi. The image forming conditions were the same for all five types of recording media.

<Heating Intensities for Recording Surface and Rear Surface in Drying Unit>

As shown in the Table in FIG. 7, the intensities of heat applied to the recording surface and the rear surface were set in three levels: "strong", "medium" and "weak". Here, "strong" indicates a case where the temperature of the recording surface and the rear surface of the recording sheet was 70° C., "medium" indicates a case where the temperature was 60° C. and "weak" indicates a case where the temperature was 50° C. Furthermore, the allowable limit temperature of the recording surface after drying, at which stickiness occurred in the image formed on the recording surface, was 72° C. The heating duration was 4.5 seconds (=1.5 seconds in the transfer drum+1.5 seconds in the drying drum+1.5 seconds in the transfer drum) and the same for both the recording surface and the rear surface. The heating duration was the same for all five types of recording media.

<Conditions of Curing Unit>

The UV curing conditions of the curing unit were 370 nm peak wavelength and 800 mJ/cm$^2$ irradiation energy with the UV lamp. The UV curing conditions were the same for all five types of recording media.

<Evaluation Criteria for Cockling>

The state of cockling formed on the recording medium was evaluated visually as follows.

A: No cockling occurs; recording quality satisfactory

B: Cockling occurs; recording quality slightly defective

C: Severe cockling occurs; recording quality defective

<Evaluation Criteria for Stacker Blocking>

When 100 sheets of recording medium had been stacked on the output tray of the output unit, the occurrence of stacker blocking was observed visually as follows.

A: Stacker blocking did not occur

B: Stacker blocking occurred sporadically

C: Stacker blocking occurred frequently

<Experimental Results>

As a result of this, when using the recording sheet having the basis weight of 104 gsm, by controlling the heating intensity for the recording surface to "strong", and the heating intensity for the rear surface to "strong", then "A" evaluation was obtained for both cockling and stacker blocking. Furthermore, stacker blocking received "A" evaluation, but cockling got "C" evaluation, by shifting the heating intensity of the recording surface from "strong" to "weak".

When using the recording sheet having the basis weight of 127 gsm, "A" evaluation was obtained for both cockling and stacker blocking by adopting a combination of the "strong" heating intensity for the recording surface and the "strong" heating intensity for the rear surface, a combination of the "strong" heating intensity for the recording surface and the "medium" heating intensity for the rear surface, or a combination of the "medium" heating intensity for the recording surface and the "strong" heating intensity for the rear surface.

When using the recording sheet having the basis weight of 157 gsm, "A" evaluation was obtained for both cockling and stacker blocking by adopting a combination of the "medium" heating intensity for the recording surface and the "strong" heating intensity for the rear surface, or a combination of the "weak" heating intensity for the recording surface and the "strong" heating intensity for the rear surface.

When using the recording sheet having the basis weight of 210 gsm, "A" evaluation was obtained for both cockling and stacker blocking by adopting a combination of the "weak" heating intensity for the recording surface and the "strong" heating intensity for the rear surface.

When using the recording sheet having the basis weight of 310 gsm, cockling received "A" evaluation for all heating intensities from "strong" to "weak" for the recording surface, but "B" to "AB" evaluation could be obtained for stacker blocking only when the heating intensity for the rear surface was set to "strong".

As can be seen from the results described above, if the recording sheet has the small thickness and the basis weight of 104 gsm, then cockling is liable to occur, and therefore it is important to suppress both cockling and stacker blocking by setting the "strong" heating intensity for the recording surface so as to promote drying of the recording surface, as well as controlling the heating intensity for the rear surface in the range of "medium" to "strong" so as to assist the promotion of drying of the recording surface, without allowing the temperature of the recording surface to rise excessively.

Moreover, the greater the thickness of the recording sheet, the less liable cockling is to occur, but as the recording sheet becomes thicker, the thermal capacity thereof becomes greater, the temperature raised in the drying unit becomes less liable to lower, and therefore stacker blocking becomes more likely to occur. Consequently, in this case, both cockling and stacker blocking can be suppressed by controlling the heating intensity for the rear surface to "strong" so as to prevent insufficient drying, while restricting the heating intensity for the recording surface.

Furthermore, if the recording medium has the relatively large thickness and the basis weight of 310 gsm, then although there is no concern with regard to cockling, it can be seen that stacker blocking is liable to occur due to insufficient drying. Therefore, in this case also, it is important to strengthen the heating intensity for the rear surface so as to avoid insufficient drying, while restricting the heating intensity for the recording surface.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An inkjet recording apparatus, comprising:

an image formation unit which deposits aqueous ink onto a recording surface of a recording sheet to form an image on the recording surface;

a drying unit which dries the recording surface on which the image has been formed, the drying unit including a double-side heat application device which performs drying of the recording surface by applying heat to both the recording surface and a rear surface of the recording sheet opposite to the recording surface;

a drying control unit which controls a first intensity of heat applied to the recording surface and a second intensity of heat applied to the rear surface independently from each other, in accordance with a thickness of the recording sheet;

a data storage unit in which a data table of correspondence between a deposition volume of the aqueous ink and an allowable limit temperature of the recording surface after drying is stored for each recording sheet type corresponding to the thickness of the recording sheet; and a data input unit through which data of the recording sheet type and the deposition volume of the aqueous ink is input, wherein the drying control unit controls the first and second intensities independently from each other so that temperature of the recording surface does not exceed the allowable limit temperature selected from the data table of correspondence in accordance with the input data of the recording sheet type and the deposition volume of the aqueous ink.

2. The inkjet recording apparatus as defined in claim 1, wherein the drying control unit makes the second intensity greater than the first intensity as the thickness of the recording sheet increases.

3. The inkjet recording apparatus as defined in claim 1, wherein the drying unit includes:

a drum which holds and conveys the recording sheet of which the rear surface is held in contact with an outer circumferential surface of the drum;

a first heating device which is arranged along the outer circumferential surface of the drum and applies heat to the recording surface of the recording sheet of which the rear surface is held in contact with the outer circumferential surface of the drum; and a second heating device which heats the outer circumferential surface of the drum so as to apply heat to the rear surface that is held in contact with the outer circumferential surface of the drum.

4. The inkjet recording apparatus as defined in claim 1, further comprising a treatment liquid deposition device which deposits treatment liquid onto the recording surface of the recording sheet, the treatment liquid deposition device being arranged before the image formation unit, the treatment liquid containing an aggregating agent having a function of increasing viscosity of the aqueous ink.

5. The inkjet recording apparatus as defined in claim 1, further comprising a curing unit which cures the image formed on the recording surface and is arranged after the drying unit.

6. An inkjet recording apparatus comprising two inkjet recording apparatuses arranged in series, each of the two inkjet recording apparatuses being as defined in claim 1, images being formed on both surfaces of the recording sheet.

* * * * *